US012515096B2

(12) United States Patent
Song et al.

(10) Patent No.: US 12,515,096 B2
(45) Date of Patent: Jan. 6, 2026

(54) KOAPT-THERAPY-BASED TREATMENT AND REHABILITATION DEVICE FOR DEGENERATIVE KNEE JOINT DISEASE

(71) Applicant: WUHAN KEDE MEDICAL INSTRUMENT CO., LTD., Wuhan (CN)

(72) Inventors: Jiuhong Song, Wuhan (CN); Xinting Liu, Wuhan (CN); Guosheng Zhang, Wuhan (CN)

(73) Assignee: WUHAN KEDE MEDICAL INSTRUMENT CO., LTD., Wuhan (CN)

( * ) Notice: Subject to any disclaimer, the term of this patent is extended or adjusted under 35 U.S.C. 154(b) by 54 days.

(21) Appl. No.: 18/655,500

(22) Filed: May 6, 2024

(65) Prior Publication Data

US 2024/0285999 A1 Aug. 29, 2024

Related U.S. Application Data

(63) Continuation of application No. PCT/CN2022/092912, filed on May 16, 2022.

(30) Foreign Application Priority Data

Nov. 8, 2021 (CN) ..... 202111313071.3

(51) Int. Cl.
*A63B 22/04* (2006.01)
*A63B 22/00* (2006.01)
*A63B 69/00* (2006.01)

(52) U.S. Cl.
CPC ..... *A63B 22/04* (2013.01); *A63B 2022/0094* (2013.01); *A63B 69/0057* (2013.01)

(58) Field of Classification Search
CPC . A63B 22/04; A63B 22/0048; A63B 22/0061; A63B 22/0076;
(Continued)

(56) References Cited

U.S. PATENT DOCUMENTS 9,999,561 B2 * 6/2018 Nelson ..... A61B 5/1121
2011/0287851 A1 * 11/2011 Okesaku ..... A63B 69/36213 482/93
2024/0342546 A1 * 10/2024 Fung ..... A63B 23/0423

FOREIGN PATENT DOCUMENTS

CN 106726358 A 5/2017
CN 107692964 A 2/2018
(Continued)

OTHER PUBLICATIONS

International Search Report issued in corresponding International application No. PCT/CN2022/092912, mailed Jul. 26, 2022 (5 pages).
(Continued)

*Primary Examiner* — Zachary T Moore
(74) *Attorney, Agent, or Firm* — HOWARD M COHN and Associates, LLC

(57) ABSTRACT

This invention discloses a device for treating and rehabilitating knee osteoarthritis. This invention standardizes the user's execution of the movement posture based on knee osteoarthritis pendulum therapy (KOAPT), helps patients overcome physical pain and psychological non-compliance, fundamentally solves the pain of KOA patients, and brings good news to knee joint degenerative disease patients around the world.

19 Claims, 12 Drawing Sheets

(58) Field of Classification Search
CPC .... A63B 2022/0051; A63B 2022/0053; A63B 2022/0058; A63B 2022/0084
See application file for complete search history.

(56) References Cited

FOREIGN PATENT DOCUMENTS

| | | | |
|---|---|---|---|
| CN | 109481237 | A | 3/2019 |
| CN | 112316378 | A | 2/2021 |
| CN | 113952677 | A | 1/2022 |

OTHER PUBLICATIONS

Written Opinion of the International Search Authority in corresponding International application No. PCT/CN2022/092912, mailed Jul. 26, 2022 (13 pages).

* cited by examiner

KOAPT-THERAPY-BASED TREATMENT AND REHABILITATION DEVICE FOR DEGENERATIVE KNEE JOINT DISEASE

CROSS REFERENCE OF RELATED APPLICATIONS

The present application is a continuation-application of International Patent Application (PCT) No. PCT/CN2022/092912 filed on May 16, 2022, which claims foreign priority of Chinese Patent Application No. 202111313071.3, filed on Nov. 8, 2021, the entire contents of which are hereby incorporated by reference.

TECHNICAL FIELD

The present invention relates to the technical fields of clinical medical device and home rehabilitation exercise, specifically referring to a KOAPT-therapy-based treatment and rehabilitation device for degenerative knee joint diseases.

BACKGROUND

The world has entered an aging society, with the proportion of the elderly population increasing year by year. Degenerative knee joint diseases have become one of the major disabling illnesses globally, seriously affecting the quality of life of the elderly. As of the end of 2018, statistics show that over 60% of people aged 65 and above suffer from knee joint pain, and the number of knee osteoarthritis patients has exceeded 150 million. China is one of the countries with the highest number of knee osteoarthritis patients.

The knee joint is the most complex weight-bearing joint in the human body, and it is also one of the joints most susceptible to injury. Knee joint disorders usually refer to a series of pathological and physiological changes within the joint cavity, including arthritis, osteoarthritis, synovitis, patellar softening, meniscus injuries, subchondral bone sclerosis, subchondral bone deformation of various kinds (becoming, e.g. convex concave-surfaced, osteoporotic, collapsed or cystically hollowed), which result from any of the various factors such as instability in the lower limb biomechanical alignment, disuse atrophy of the lower limb, prolonged incorrect working or sitting postures, inadequate blood supply to the lower limbs, joint cavity infections, primary and metastatic tumors within the joint cavity, osteoporosis by endocrine disorders, and high-energy external injuries. Knee osteoarthritis (KOA), also known as proliferative knee arthritis or senile knee arthritis (commonly known as "cold legs" in Chinese), is the most common chronic degenerative joint disease. The earliest and most significant pathological changes occur in the cartilage, followed by subchondral bone cystic lesions, formation of osteophytes at the joint margins, and eventually destruction and deformity of the normal joint surface, With the arrival of an aging society in China, both the incidence and total numbers of patients with knee osteoarthritis (KOA) are showing a significant increasing trend. KOA patients suffer great physical pain: they experience significant agony and weakness in the knees when going up and down stairs, and feel fatigued and uncomfortable when walking for a long time. Severe patients may even be unable to stand alone and must rely on support to stand. Long-term sufferers not only have a significantly reduced quality of life, but also inevitably suffer from psychological trauma.

Modern clinical medicine has proposed different treatment plans for KOA patients at different stages of the Kellgren-Lawrence (K-L) grading. In terms of drug treatment, both locally acting analgesics and systemic analgesics widely used in clinical practice have limitations. They cannot fundamentally address the pathological and physiological changes of KOA, nor can they prevent further deterioration. They can only temporarily relieve pain for a very limited time, and cannot address issues such as muscle weakness, muscle atrophy, and organic lesions such as meniscal cysts, meniscal tears, cartilage fractures, tears of anterior and posterior cruciate ligaments, and lower limb biomechanical instability. Long-term use also carries a series of potential adverse reactions. Total Knee Arthroplasty (TKA, UKA) is another major category of treatment applied to KOA patients at the fourth stage of the K-L grading. However, this type of surgery involves destructive reconstruction and causes significant damage, resulting in low patient acceptance. Moreover, after knee replacement surgery, patients' knee muscle strength and lower limb proprioception cannot meet the demands of normal daily activities. Particularly, as a result of the fact that the entire lower limb proprioception system has been compromised, patients face a continuous and indefinite risk of falling in the future. Other treatment options such as weight reduction, orthotic devices, intra-articular hyaluronic acid sodium injections, autologous platelet-rich plasma (PRP) injections, intra-articular ozone injections, and so on, have limited effectiveness, only providing short-term control of local symptoms and limited slowing of functional decline. In the long term and from a systemic perspective, these treatments have significant limitations and cannot fundamentally resolve knee joint pain, provide sufficient muscle support around the knee joint, restore good proprioception for patients in the course of voluntary motion, and achieve efficient painless and damage-free systemic treatment at any time and any place.

In the "Clinical Practice Guidelines for the Management of Osteoarthritis Pain in China (Chinese Journal of Orthopedics, Edition 2020)", exercise therapy has been designated as a 1A (the most strongly recommended level) choice for treating Knee Osteoarthritis (KOA). As early as the Western Han Dynasty in China, the "Yinshu" (Book of Remedies) proposed a prescription for "Knee Pain Guidance": "For knee pain, if the right knee hurts, clench the left hand, and swing the right foot inward, repeating a thousand times; if the left knee hurts, clench the right hand, and swing the left foot inward, repeating a thousand times. Hook the left toes with the left hand, pull them back, repeating ten times. Then, support with the left hand clenched, hook the right toes with the right hand, pull them back, repeating ten times." This instructs patients to perform leg swinging exercises, promoting leg muscle contraction and relaxation to enhance leg blood circulation. The generation of heat through leg swinging helps alleviate the symptoms of cold and pain in the lower leg, reflecting this practice's underlying principle of "activating blood circulation, resolving stasis, warming the Jing Mai (a definition in traditional Chinese medicine, means passages through which vital energy circulates) and dispelling cold". Treating knee pain through the Knee Pain Guidance is an effective and classic therapy for degenerative knee joint conditions. Leg swinging can effectively treat knee joint pain, but in modern clinical applications, most KOA patients do not fundamentally benefit from it for the reasons listed as follows:

From a psychological perspective: Due to the monotony of the exercise, patients feel mentally restless and cannot consistently adhere to the Knee Pain Guidance exercise.

2. From a physical standpoint: Single-leg support and swinging, with over 1000 repetitions on each side daily, lead to physiological discomfort and resistance in the initial stages of treatment, making it difficult to form habitual tolerance of and cultivate daily compliance with the requirements of the Knee Pain Guidance, ultimately failing the treatment.

3. From the perspective of modern evidence-based medicine: Although Knee Pain Guidance has been clinically recognized by patients for two thousand years, its scientific fundamentals are not yet clear, and nor are the movement standards well-defined. Knee Pain Guidance cannot convincingly become a standard clinical treatment for KOA for modern clinicians.

Currently, there is no treatment method or product in the world that fundamentally resolves the pain of KOA that can comprehensively surpass Knee Pain Guidance in terms of cost-effectiveness and in respect of pathophysiological fundamentals. The researchers of this invention have long committed to the study of KOA diagnosis and treatment methods, proposing the K-KOA (Kill Knee Osteoarthritis, KKOA) staged therapy based on the K-L grading and the modern standard leg-pendulum-motion therapy for KOA at specific stages (Knee Osteoarthritis Pendulum Therapy, KOAPT). There are similarities and differences between KOAPT and the Knee Pain Guidance. Both aim to treat KOA through leg swinging. However, compared to the rough description of treatment steps of the Knee Pain Guidance, KOAPT is a more precise, standardized, and continuous rehabilitation treatment method that addresses the root causes of KOA, designed to remove both pain symptoms and weakness of the muscles around the knee joint. KOAPT can reduce the intra-articular pressure of the knee joint, thereby promoting intra-articular blood circulation, synovial fluid circulation, and enhancing the metabolism of intra- and peri-articular tissues. It can also efficiently strengthen the anterior and posterior leg muscles and significantly improve the sensitivity of the lower limb proprioceptors.

The inventor of this device is the person proper who first made the relevant scientific discovery, which will be published for the first time in the UK medical journal 'Trails'.

Therefore, a treatment and rehabilitation device like this invention is urgently needed to help bring the curing potentials of KOAPT into reality.

SUMMARY

To overcome the shortcomings of existing technologies, this invention discloses a treatment and rehabilitation device for knee osteoarthritis based on the therapy, which urges patients to exercise the KOAPT in conformity with their respective schedules and keep their leg swinging movements up to standard. This helps KOA patients overcome the physiological and psychological pains and resistance to KOAPT exercises during the treatment process, and eventually addresses the root causes of the pains experienced by KOA patients through continuous and repeated KOAPT exercises, bringing hopes of a painless life to KOA patients worldwide.

To achieve the above purpose, a device for treating and rehabilitating knee osteoarthritis is designed based on knee osteoarthritis pendulum therapy, the therapy requires users to perform leg swinging movements as a treatment, the device comprises a body data collection component, a motion quantity data collection component, a support component, a control component, and a feedback component;

the support component is used to provide trunk support and/or waist support and/or elbow support for the user;

the body data collection component is installed on the support component to collect a body data of the user during use of the device, the body data includes elbow support point height, reduction of body weight on the supporting leg, trunk upright status value, and leg upright state value;

the motion quantity data collection component is installed on the support component to collect a motion quantity data of the user's leg swinging movements during use; the motion quantity data includes movement quantity, movement frequency, and movement amplitude of leg swinging movements;

the control component comprises preset databases and a built-in computer program, the computer program receives the body data sent by the body data collection component in real-time and determines in real-time whether the body data matches values in the preset databases, the values in the preset databases meet the requirements of the knee osteoarthritis pendulum therapy; when the body data doesn't match the values, the feedback component receives feedback instructions from the control component and communicates corresponding information to the user, to correct the user's movement posture; the preset databases includes graduated treatment models, the computer program also receives the motion quantity data sent by the motion quantity data collection component in real-time, and guide the user to complete the treatment according to the graduated treatment models;

the feedback component is used to send audio and/or video and/or tactile signals to the user according to the feedback instructions from the control component.

Furthermore, the built-in computer program includes a graduated treatment models storage module, a body data analysis module, a treatment process control module, a treatment tracking module, a feedback information storage module, and a user information storage module;

the graduated treatment models storage module is used to store the graduated treatment models;

the body data analysis module inputs the body data into a body data analysis model preexisted in the preset databases, real-time determines whether the body data matches values in the body data analysis model, and output judgment instructions; When the body data doesn't match, the body data analysis module simultaneously outputs a incorrectness flag;

the treatment process control module is used to call the feedback instructions according to the body data judgment instructions; the treatment process control module matches the motion quantity data collected by the motion quantity data collection component with values in the graduated treatment models, and according to matching results, calls the feedback instructions; the feedback instructions are stored in the feedback information storage module;

the treatment tracking module monitors the completion degree of the treatment and call the feedback instructions accordingly;

the feedback information storage module includes count standard feedback information, body data standard feedback information, incentive feedback information, separation alarm information, and media information;

the user information storage module stores the user's personal information, body data, and motion quantity data.

Furthermore, the body data analysis model is represented by the equation $y=k1+k2+k3+k4+k5$, wherein y is the user's body data indicative value, k1 is trunk upright indicative value, k2 is leg upright indicative value, k3 is supporting leg load reduction indicative value, k4 is comfort indicative value, and k5 is redundancy indicative value;

When y=0, the user's body data is determined as matched, and when y=1, the user's body data is determined as unmatched, that is, outputting the incorrectness flag.

Furthermore, a calculation formula for the comfort indicative value is $k4=\text{round}(\alpha Q+\beta S+\gamma T+\delta N)$, wherein Q is ratio of the elbow support point height to body height, when the user has two arms on each side of the body as a form of support;

S is ratio of the supporting leg load reduction to body weight, when the user has two arms on each side of the body as a form of support;

T is ratio of the elbow support point height to body height, when the user places two arms in front of the chest as a form of support;

N is the ratio of the supporting leg load reduction to body weight, when the user places two arms in front of the chest as a form of support; and $\alpha$, $\beta$, $\gamma$, $\delta$ are model parameters obtained through parameter calibration, pre-set on the basis of the body data; and 'round( . . . )' represents rounding.

the graduated treatment models consist of X1, X2 and X3 level treatment models; each graduated treatment model has preset multiple parameters, including: graduated period, swinging times of supporting the body on one leg V, movement amplitude $\theta$, movement frequency $\omega$, leg assistance force F, movement quantity C, necessary supporting leg rest time t, and supporting leg load reduction $\Delta a$; wherein the movement quantity C can be calculated by using the movement frequency $\omega$ multiplies time.

In one embodiment of the invention, the support component includes a folding leg swing mechanism and a multifunctional support frame; the folding leg swing mechanism is used to support the user's torso, while the multifunctional support frame is used to support the user's elbows, and both are fixed and connected.

Optionally, the folding leg swing mechanism includes a shell, two foot pedals, two folding telescopic frames, a motor, two swing angle frames, and a lower leg length adjustment frame;

the shell serves as a bottom support, with the two foot pedals mounted on the shell; the two folding telescopic frames vertically set above the shell are fixed by shell rods; upper ends of the two swing angle frames are respectively suspended on the folding telescopic frames to achieve back and forth swinging relative to the folding telescopic frames; lower ends of the two swing angle frames are inserted into the lower leg length adjustment frame and being fixed into a single unit; the motor is located at the upper end of one of the swing angle frames, driving the swing angle frames and lower leg length adjustment frame to swing back and forth;

the control component is configured to control the motor based on the graduated treatment models, thereby driving the swing angle frame to rotate.

Optionally, the multifunctional support frame includes a support base, two support rods, and two elbow and underarm dual-purpose support brackets; the support base is located at a bottom of the multifunctional support frame, the two support rods symmetrically positioned above the support base; the support rods are connected to a support adjustment rod via a cam handle, and a reinforcing flange is arranged below the support adjustment rod; the elbow and underarm dual-purpose support brackets are horizontally positioned at a top of the support adjustment rod.

Optionally, the lower leg length adjustment frame includes a U-shaped frame, guide rods, and a first slider; the lower leg length adjustment frame is connected to the two swing angle frames through two ends of the U-shaped frame, respectively; a footrest plate mounted on the first slider, and slides along a length direction of the guide rod on the U-shaped frame to adjust its relative position to the U-shaped frame, in order to accommodate the leg length of users of different heights.

Preferably, the device comprises a terminal support frame and a display screen, the terminal support frame is used to support and adjust height and angle of the display screen.

In an optional configuration, the device comprises two flip-folding seats respectively installed on tops of the two folding telescopic frames, and the two flip-folding seats are connected through a gear case and a coupling.

In another optional configuration, the device comprises a flip-folding seat installed on a top of the folding telescopic frame, and the flip-folding seat is hinged with an upper end of the folding telescopic frame.

Optionally, the body data collection component includes a first sensor group, a second sensor group, and a third sensor group for collecting body data of the user, and the motion quantity data collection component includes a fourth sensor group for collecting the user's motion quantity data.

Optionally, the first sensor group includes photoelectric sensors placed in front of and behind the foot pedals on the support component; two receiving ends of the photoelectric sensors are vertically positioned above its two emitting ends respectively; when the user performs leg swinging movements, if the receiving end receives the photoelectric signal which is not blocked by the user, the first sensor group output a value of 0 for trunk upright status, i.e. k1=0; when the receiving end does not receive the photoelectric signal due to it being blocked by the user, the first sensor group output a value of 1 for the upright trunk status, i.e. k1=1.

Optionally, the second sensor group includes displacement sensors placed on the lower leg length adjustment frame corresponding to the back of the user's knees; the displacement sensors continuously collect a fitting status of the user's leg with the lower leg length adjustment frame; when the leg are fitted to the frame, the second sensor group output a value of 0 for the upright status of the leg, i.e. k2=0; when they are not, the second sensor group output a value of 1 for the upright status of the leg, i.e. k2=1.

Optionally, the third sensor group includes weight sensors placed under the foot pedals of the support component to continuously collect the user's weight data;

a method for calculating the supporting leg load reduction indicative value, comprising: determine whether S or Nis in a range of Aa, if it is within the range, the third sensor group output is k3=0; otherwise, the output is k3=1;

wherein S represents ratio of the supporting leg load reduction while on support of two sides of the body to body weight, N represents ratio of the supporting leg load reduction while on support of the chest front to body weight, Δa represents the supporting leg load reduction in the graduated treatment models.

Optionally, the fourth sensor group includes a photoelectric sensor on a side of the outer shell and a distance sensor; a method for collecting the movement amplitude involves placing a distance sensor on the surface of the bottom support of the support component; the movement amplitude θ is calculated as $\theta=\arctan(D/(H-L))$, wherein H is the distance from the user's leg pivot to the surface of the bottom support, L is the distance between the distance sensor and the obstructing object, and D is the projected distance from the distance sensor to the user's leg pivot.

Optionally, the comfort indicative value is determined to be 1, the control component commands the feedback component to issue audio and/or video and/or tactile signals to the user, guiding him/her in adjusting the height of the waist support and/or elbow support, or automatically adjusts the height of the waist support and/or elbow support until the comfort indicative value is determined to be 0.

Optionally, the body data collection component and the motion quantity collection component are achieved functions by selecting one or more from the following: ultrasonic sensor, displacement sensor, gravity sensor, photoelectric sensor, radar, camera.

The KOA (Knee Osteoarthritis) disease is classified in imaging examinations pursuant to the KL (Kellgren-Lawrence, K-L) Grading System. Under this System, the severity of the condition of a KOA patient is identified and an individual plan is worked out accordingly for his/her treatment.

The grades of the K-L Grading System is as follows:

Grade 0: Completely normal joint.

2. Grade I: Slight osteophyte formation in the joint, but no significant narrowing of the joint space.
3. Grade II: Narrowing of the joint space and osteophyte formation.
4. Grade III: Moderate osteophyte formation, clear narrowing of the joint space, sclerosis of the bone under the cartilage, or joint deformities such as varus or valgus deformities.
5. Grade IV: Extensive bone spurs, severe narrowing of the joint space, obvious bone sclerosis, and very apparent joint deformities.

Common physiological conditions in KOA patients include heavy weight, atrophy and weakness of the flexor and extensor muscle groups around the knee joint (such as quadriceps, hamstring muscles . . . ), and an age usually over 45 years old.

Common symptoms in KOA patients include knee joint movement pain, instability when walking on flat ground, weakness when ascending or descending stairs, and compensatory deformities in body shape.

Pathological changes in the body of KOA patients include degeneration and deformation or even rupture of knee joint cartilage, narrowing of the knee joint space, uneven surface of the subchondral bone, formation of osteophytes and bone spurs, increase in inflammatory factors in synovial fluid within the joint cavity, fragments of cartilage and subchondral bone, even depositing of fragmented joint tissues in the joint cavity.

The present invention is developed based on the various internal and external conditions and the unique physiological and pathological reasons of KOA patients at different stages of the disease. It aims to guide, supervise and drive KOA patients to perform KOAPT exercises, and to advise them in due course to perform right and up to scientific standards. Simultaneously, the KOAPT machine-guided KOAPT exercise treatment, in conjunction with other specific KOA treatment methods (such as arthroscopic lavage, debridement, and repair; lower limb alignment correction surgery; postoperative lower limb muscle strength rehabilitation training for UKA, TKA . . . ), forms a treatment plan, namely the KKOA (Kill Knee Osteoarthritis, KKOA) treatment plan, which is rightly graded, integrates different-measures, and covers all KOA stages.

This KOAPT machine is invented on the basis of the prescribed movements of the "Knee Pain Guidance", and rigorous pathophysiologic and rehabilitation-kinesiological rationales, and through the analysis of results of both clinical research into a large group of KOA patients and animal experiments. The principles of the invention include:

During KOAPT exercises, the pressure in the knee joint cavity decreases, leading to accelerated blood circulation through and over relevant tissues in the knee joint cavity. This, in turn, increases the efficiency of clearing inflammatory pain factors within the joint cavity and enhances tissue repair capabilities. The relevant tendons and ligaments located inside or outside the knee joint that had contracted gradually loosen, increasing the joint space. The pressure on the subchondral bone decreases and, because there are abundant nerve endings on the subchondral bone, a significant reduction in KOA pain is reported.

2. KOAPT exercises can effectively and progressively increase the strength of the surrounding flexor and extensor muscle groups of the knee joint, which are necessary for normal movement, while minimizing the pains experienced by KOA patients, until the muscle strength necessary for normal daily activities are regained.

3. Performing leg swings more than a thousand times each day, consistently for over a year, has a positive effect on reducing the weight burden. Conversely, weight gain and lack of proper lower limb muscle exercise are the main contributing factors to the occurrence and progression of KOA. As weight increases and the knee pains worsen, the patient will become more reluctant and resistant to do knee joint movements of any kind, leading to a vicious cycle. However, KOAPT under the guidance of the KOAPT machine serve as a brilliant antidote to it.

According to modern evidence-based medical theory and clinical observations over the past five years, the Knee Pain Guidance does not scientifically specify the duration of continuous leg support. However, prolonged single-leg support may cause ischemic and compressive lesions in the subchondral bone of the supporting leg, resulting in increased pain and accelerated functional degeneration. Additionally, the range and frequency of leg swings have not been scientifically validated and limited to their maximum and minimum values.

Description and explanation of individual differences in body gravity line during the overall swinging process, head and neck angles, arm support point height, patient strength, height, weight, age, and other factors have not reached the level where common fundamentals of mutual benefit and non-contradiction while functioning parallel meet practices of individualized diagnosis and treatment in dialectical unification. Compared to existing technologies, the beneficial technical effects of this invention are evident in:

If KOA patients do not engage in the Knee Pain Guidance exercises for two consecutive weeks, the pressure within the joint cavity will increase, leading to reduced blood and synovial fluid circulation in the joint tissues, resulting in decreased synovial fluid and spells of pain. This invention enables users to engage in KOAPT exercises continuously.

(2) This invention utilizes a CCR system to supervise, correct, and provide feedback on KOAPT exercise postures, in order to achieve the purposes of standardizing correct and comfortable exercise postures and, in a proactive mode, assisting patients in overcoming physical pains and psychological resistance experienced during exercise.

(3) This invention designs information feedback from multiple dimensions, with a view to addressing the problem of restlessness caused by monotonous exercise, enabling patients to engage in the Knee Pain Guidance exercise with attention and composure, and freeing their hands so that they can work and communicate with others simultaneously.

(4) This invention is embodied in models of different external features in order to accommodate conditions of different environments such as medical institutions, home, and travel stays, and all models come with portability, reliability, convenience and durability.

Figure 1:
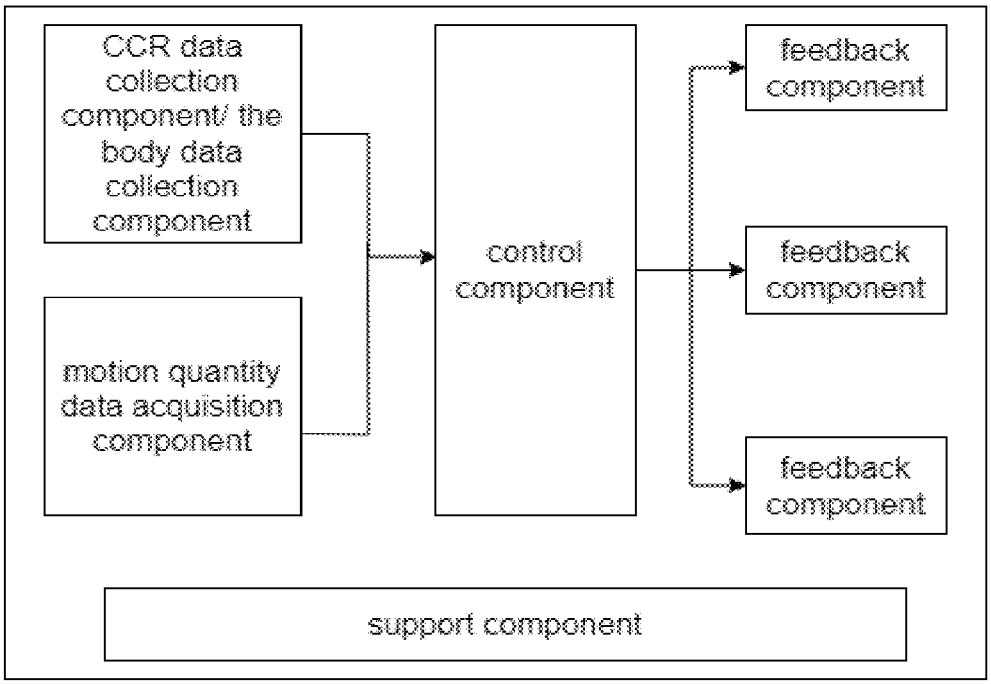
FIG. 1 is schematic diagram of the system structure of the device for treating and rehabilitating knee osteoarthritis, the device is designed based on knee osteoarthritis pendulum therapy.

Folding leg swing mechanism 1, Multi-functional support frame 2, Multi-functional support adjuster 3, Terminal support frame 4, Display 5, First sensor group 61, Second sensor group 62, Third sensor group 63, Fourth sensor group 64, Flip-folding seat 10;

the Folding leg swing mechanism 1 includes: Pivot 1*a*, Housing 11, Pivot hole 11*a*, Housing linkage-fastening hole 11*b*, Foot pedal 12, Massage protrusion 12*a*, Anti-slip protrusions 12*b*, Folding telescopic frame 13, Motor 14, Swing angle frame 15, Lower leg length adjustment frame 16, Gear case 17, Coupling 18, locking handle 19, Pedal surface 121, Telescopic rod 131, Folding frame 132, Linkage pivot 132*a*, Housing linkage 133, First rod body 151, Second rod body 152, First reinforcing flange 153, U-shaped frame 161, First securing frame 162*a*, Second securing frame 162*b*, Second slider 163*a*, Third slider 163*b*, Guide rod 164, First slider 165, Footrest plate, 165*a*, Plate linkage 165*b*, Locking mechanism 165*c*, First guide hole 164*a;* the multifunctional support frame 2 includes: support base 21, support rod 22, Cam locking ring 23, support adjustment rod 24, support bracket locking ring 25, elbow and armpit dual-use support bracket 26, guide rail mounting hole 211, support rod fixing hole 212, third rod 241, fourth rod 242, second reinforcing flange 243;

the multifunctional support adjuster 3 includes: first guide rail 31, second guide rail 32;

the terminal support frame 4 includes: straight frame 41, rotating U-shaped frame 42, remote control holder 43, all-direction adjustment bracket 44.

DETAILED DESCRIPTION OF THE EMBODIMENTS

The following is a detailed description of the present invention in conjunction with the accompanying drawings and specific embodiment cases.

Definition

KOAPT: Knee Osteoarthritis Pendulum Therapy, the therapy requires users to perform leg swinging movements as a treatment;

Graduated Treatment Models: match the user to a treatment model in accordance to his personal information input or the doctor's advice on exercise; The grading of treatment for a disease according to the severity of the patient is familiar to those skilled in the art. Moreover, the multiple preset treatment options included in a graduated treatment model may vary depending on the settler. In the following embodiment, the graduated treatment models are set by the inventor, but can be replaced by other KOA treatment models in the prior art.

CCR: Correct and Comfortable Relationship body data, refers to the relationship between correct and comfortable body postures subject to KOAPT requirements and body movement forms; in the present invention, the body data includes elbow support point height, reduction of body weight on the supporting leg, trunk upright status value, and leg upright state value;

Elbow Support Point Height: height from the surface of foot pedals to the elbow support point, there are two forms of the user's posture, one is the user has two arms on each side of the body as a form of support; the other is the user places two arms in front of the chest as a form of support;

The User's CCR Indicative Value y: the value indicates whether the user's Correct and Comfortable Relationship body data correct; 1 is for correct and 0 is for incorrect;

Trunk Upright Indicative Value k1: the value indicates whether the user's trunk upright, 1 is for correct and 0 is for incorrect;

Leg Upright Indicative Value k2: the value indicates whether the user's leg upright, 1 is for correct and 0 is for incorrect;

Supporting Leg Load Reduction Indicative Value k3: the value indicates whether the user's leg load reduction, 1 is for correct and 0 is for incorrect;

Comfort Indicative Value k4: the value indicates whether the user's posture comfort, 1 is for correct and 0 is for incorrect;

Redundancy Indicative Value k5: with a default value of 0.

The user's leg pivot: the 'pivot' in this phrase corresponds to the greater trochanter of the user's leg. the pivot point of the leg swinging movements is only the greater trochanter.

The device for treating and rehabilitating knee osteoarthritis, which is designed based on knee osteoarthritis pendulum therapy, the therapy requires users to perform leg swinging movements as a treatment, as shown in FIG. 1, the device includes the CCR data collection component, motion quantity collection component, support component, control component, and feedback component.

The support component: used to provide trunk support and/or waist support and/or elbow support for the user. The support component is designed with different external features in order to fit different users and scenarios. Though the present embodiment proposes a folding component structure, it doesn't limit other functions of the support component. Mechanisms that provide trunk support and/or waist support and/or elbow support for the user while the system is in operation are all included in the support component described in the present invention.

CCR data collection component/the body data collection component: installed on the support component, it is used to collect CCR data of the user on KOAPT requires on this device. CCR, short for Correct and Comfortable Relationship, refers to the relationship between correct and comfortable body postures subject to KOAPT requirements and body movement forms. CCR data includes user height, distance between elbow support point and stepping point, height of support on both sides, height of chest support, user weight, weight on support of both sides, weight on support of chest, upright status of trunk, upright status of legs, etc.

The motion quantity collection component: Installed on the support component, it is used to real-time collect the motion quantity data of leg swinging movements during use. Motion quantity data includes movement quantity, movement frequency, and movement amplitude of leg swinging movements;

The control component: comprises preset databases and a built-in computer program, i.e. KOAPT computer program. the KOAPT computer program receives the CCR data sent by the CCR data collection component in real-time and determines in real-time whether the CCR data matches values in the preset databases, the values in the preset databases meet the requirements of the knee osteoarthritis pendulum therapy; when the CCR data doesn't match the values, the feedback component receives feedback instructions from the control component and communicates corresponding information to the user, to correct the user's movement posture; the preset databases includes graduated treatment models, the computer program also receives the motion quantity data sent by the motion quantity data collection component in real-time, and guide the user to complete the treatment according to the graduated treatment models.

The control component includes a control device, communication module, power module, etc.; and the communication module can use transmission methods such as WIFI, wireless Bluetooth, etc. The control device can be set on the support component, interact with the user through the human-computer interactive display screen, or be remotely set on the server to communicate with the user through the mobile device, or the server directly send control instructions to the feedback component mounted on the support component.

The feedback component: used to transmit audio and/or video and/or tactile signals to the user according to instructions of the control component. The part of the feedback component which does this can be a display screen, speaker, massage protrusions, motor, etc., installed on the support component; It transmits visual or audio information, or does it through controlling the vibration of massage protrusions or driving the support component to move in a particular manner. The feedback component can also be integrated into a mobile device, transmitting visual, audio or other types of information etc., according to instructions of the control component.

Figure 2:
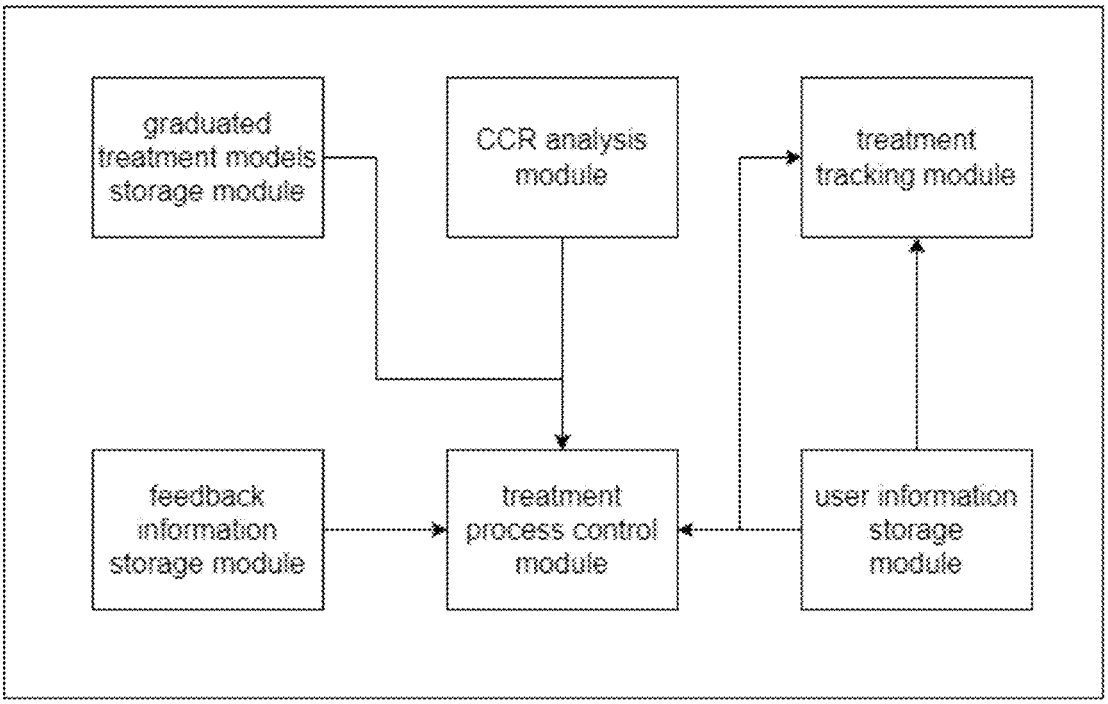
FIG. 2 is system architecture diagram of the built-in computer program.

The structure diagram of the KOAPT computer program, shown in FIG. 2, presents all its component modules, namely the graded model storage module, CCR analysis module, treatment process control module, treatment tracking module, feedback information storage module and user information storage module, and their structural relations.

graduated treatment models storage module: used to store the graduated treatment models;

CCR analysis Module: used to input the real-time collected CCR data into the CCR analysis model preexisted in the preset databases, real-time determines whether the user's posture information, and to output CCR judgment instructions; when the user's CCR doesn't match, it simultaneously outputs an incorrectness flag;

the treatment process control module: is used to call the feedback instructions according to the CCR data judgment instructions; the treatment process control module matches the motion quantity data collected by the motion quantity data collection component with values in the graduated treatment models, and according to matching results, calls the feedback instructions; the feedback instructions are stored in the feedback information storage module;

the treatment tracking module: used to monitor and control the completion progress of the user's treatment process and to call the corresponding feedback instructions in the feedback information storage module; the feedback information storage module includes count standard feedback information, CCR standard feedback information, incentive feedback information, separation alarm information, and media information;

user information storage module: used to store the user's personal information, CCR data, and motion quantity data.

The graduated treatment model includes Level X1, Level X2 and Level X3 treatment models. Each graduated treatment model has preset multiple parameters, including: graduated period, swinging times of supporting the body on one leg V, movement amplitude θ, movement frequency ω, leg assistance force F, movement quantity C, necessary supporting leg rest time t, and supporting leg load reduction Δa; wherein the movement quantity C can be calculated by using the movement frequency ω multiplies time. The parameters of the graduated treatment model are shown in Table 1. For example, the X1 level treatment model is suitable for individuals with a BMI over 28 who are unwilling to exercise voluntarily, experiencing severe knee pain and diagnosed K-L grade 3 or above. For these X1 level users, within 0-8 weeks, additional force is applied to the swinging leg; the times of supporting the body on one leg Vis 50; the movement amplitude θ is from −30 to +30°; the movement frequency ω is 30 times per minute; the support component's motor provides leg assistance force F; the movement quantity C is 500 times; the necessary supporting leg rest time tis at least 1 minute; and the supporting leg load reduction is ≥20%, with the user's body weight as the reference value.

Graduated treatment models can match the user to a treatment model in accordance to his personal information input or the doctor's advice on exercise. Table 1 shows the clinical corresponding indices of graduated treatment models needed to assist treatment.

TABLE 1

| Treatment Model | Graduated Period | Leg Assistance Force F | Rehabilitation Goal | Movement Amplitude θ | Swinging times of supporting the body on one leg V | Necessary supporting leg rest time t |
|---|---|---|---|---|---|---|
| X1 Level Treatment Model | 0-8 weeks | Additional Force | Adaptive exercise | >±30° | 50 | >1 min |
| | 9-12 weeks | | Pain alleviation | −30~+45° | 50-60 | >1 min |
| X2 Level Treatment Model | 13-16 weeks | Active Exercise | Pain elimination, tissue regrowth initiated | >±30° | 50 | >1 min |
| | 17-20 weeks | | | >±30° | 50 | >1 min |
| | 21-24 weeks | | tissue regrowth | −30~+45° | 80 | >1 min |
| | 25-52 weeks | | Maintenance exercise: quadriceps, biceps and hamstrings | | 100 | >1 min |
| X3 Level Treatment Model | 53-104 weeks | Resistance (adjustable) | Degenerative changes inhibited, Strengthened muscle exercise: quadriceps, biceps and hamstrings | −30~+45° | 100 | >1 min |

| Treatment Model | Graduated Period | Movement Quantity C | Supporting leg Load Reduction Δa | Duration | Target Population |
|---|---|---|---|---|---|
| X1 Level Treatment Model | 0-8 weeks | 500 | ≥20% | Need to be done daily, recommended to be completed at once; if not possible, done in two or three sessions | Obese with BMI ≥28, unwilling to exercise, moderate to severe pain, K-L grade 3 and above |
| | 9-12 weeks | 500 | ≥20% | | |
| X2 Level Treatment Model | 13-16 weeks | 500 | ≥10% | Need to be done daily, recommended to be completed at once | Normal weight, having some exercise habits and capabilities, mild pain or no pain, K-L grade below 3 |
| | 17-20 weeks | 500 | ≥10% | | |
| | 21-24 weeks | 800 | ≥10% | Need to be done daily, recommended to be completed at once | |
| | 25-52 weeks | 1000 | 0~5% | | |

TABLE 1-continued

| | | | | | |
|---|---|---|---|---|---|
| X3 Level Treatment Model | 53-104 weeks | 1000-1200 | 0~5% | Need to be done daily, recommended to be completed at once | having needs of enhanced exercise |

Generally, KOA patients can complete smoothly the KOAPT exercise within the swinging angle absolute-value range of 60° (±30° or above. In cases where patients suffer muscle atrophy, decreased muscle strength and obesity, we found in clinical trials that if the KOAPT exercise angle range is 60° (±30) or below, the efficiency of improving the strength of the knee flexors and extensors is too low.

Additionally, only negligible decrease of the pressure within the joint cavity is recorded in experiments, i.e., an average of only 5 mm water column. The decrease in pressure is so small that it leads to little increase in blood circulation in and around tissues within the joint cavity, and very low efficiency in loosening contracted connecting tissues (such as the anterior and posterior cruciate ligaments, medial and lateral collateral ligaments, patellar tendon, etc.)

However, when the absolute-value swinging angle of the patient on KOAPT exercise is above 60° (±30°, the average pressure decrease in the knee joint cavity is above 15 mm water column. It is evident that when the absolute-value swinging angle range is above 60° (±30°, the KOAPT has significant positive effect on pain relief, tissue regrowth, and improvement of muscle strength for KOA patients.

During the swinging exercise, the load on the supporting leg of the KOA patient is reduced for more than 20% (which is also one of the focuses of this invention). The reduction directly leads to a decrease in the pressure in the knee joint cavity of. Its clinical significance has been, through statistical analysis of treatment data, effectively verified in traditional KOA exercise therapies, such as swimming, supine pedaling, knee pain traction, the statistical treatment effects. Notwithstanding, KOAPT is the simplest, most comfortable, efficient, and sustainable among all these exercises.

The pressure in the knee joint cavity will increase as the body weight increases, thereby exacerbating degenerative changes in the knee cartilage and subchondral bone. We found that, during KOAPT exercise, the pressure borne by the supporting leg joint reaches four times that of the normal state. The number of continuous swinging cycles of KOAPT exercise should be limited within a framework of graduated levels on the basis of the K-L grading, real-time weight and muscle strength of the patient. For example, in the first level of KOAPT, 0-8 weeks of continuous swinging on one leg for 50 cycles each time did not cause any discomfort in the supporting leg. Conversely, we found that when it is raised to 100 cycles or above, patients experienced dull pain in the knee joint of the supporting leg and intermittent limping in daily life.

To achieve the treatment goals fully, KOAPT must be implemented in a way that satisfies truly the requirements of both the orthopedic medicine and the social surroundings in which it is performed. It is subject to this condition that the comprehensive systemic list of KOAPT indices of exercise positions and quantities has been developed.

CCR analysis module: used to input real-time CCR data into the analysis model, to make real-time judgments about user postures, and to output CCR judgment instructions. CCR adjustment: The user stands on this device, input personal information (gender, age, height, weight, facial information, K-L grading, pain indicators, doctor's directions about exercise, self-appointed supervisor's contact information, etc.); The control system imports the user-specific graduated treatment model, measures the user's height, weight (or input), calculates elbow height and thigh and calf lengths based on the height and weight, and automatically adjusts the elbow support point height and thigh and calf support lengths; The user confirms or makes minor adjustments and stores the settings.

The CCR analysis model is represented by the equation $y=k1+k2+k3+k4+k5$, where y is the user's CCR indicative value, k1 is the trunk upright indicative value, k2 is the leg upright indicative value, k3 is the supporting leg load reduction indicative value, k4 is the comfort indicative value, and k5 is the redundancy indicative value When $y=0$, the user's CCR is correct, and when $y=1$, the user's CCR is incorrect.

The calculation method for the trunk upright indicative value k1 is as follows: when the trunk upright status value collected by the motion data collection component is 0, $k1=0$, and when the trunk upright status value is 1, $k1=1$. The calculation method for the leg upright indicative value k2 is: when the leg upright status value collected by the CCR data collection component is 0, $k2=0$, and when the leg upright status value is 1, $k2=1$. The calculation method for the supporting leg load reduction indicative value k3 is as follows: determine whether S or Nis within the range of the supporting leg load reduction in the given graduated treatment model, Δa for short. If it is within the range, the output is $k3=0$; otherwise, the output is $k3=1$. The calculation method for the comfort indicative value is $k4=\text{round}(\alpha Q+\beta S+\gamma T+\delta N)$, α, β, γ, δ are model parameters obtained through parameter calibration, pre-set on the basis of user body data; and 'round( . . . )' represents rounding. The redundancy indicative value k5 is an indicative value with a default value of 0.

S is ratio of the supporting leg load reduction to body weight, when the user has two arms on each side of the body as a form of support, collected when the user places his arms on both sides of his body and supports his body on the elbow, to the user's weight. N is the ratio of the supporting leg load reduction to body weight, when the user places two arms in front of the chest as a form of support, collected when the user places his arms in front of his chest and supports his body on the elbow. Different treatment models have different requirements for the supporting leg load reduction Δa. Adjusting the height elbow supports or the user's support posture can keep the values of S and N within the range of Aa assigned to a particular model. Weight data is collected through weight sensors mounted on the trunk support component.

Q is ratio of the elbow support point height to body height, when the user has two arms on each side of the body as a form of support when the user places his arms on both sides of his body and supports his body on the elbow, to the user's height. Tis ratio of the elbow support point height to body height, when the user places two arms in front of the chest as a form of support, when the user places his arms in front of his chest and supports his body on the elbow, to the user's height. User height can be obtained through input or collected by sensors. The height of elbow supports can be adjusted manually by the user or automatically by a motor.

The comfort indicative value can be calculated based on the user's input of personal information or adult body inertia parameters. The ratio of the elbow support point height to shoulder height is between 0.79 and 0.91; the ratio of the elbow support point height to body height is between 0.65 and 0.75; The distance between the stepping point and the elbow support point is between 29-45 cm, concentrated around 35 cm. The ratio of the distance between the stepping point and the elbow support point to the length of the upper arm is between 0.9 and 1.4, mostly between 1.1 and 1.3. The value of Q on both sides to the height is between 0.62 and 0.67, and the value of Tin front of the chest to the height is between 0.64 and 0.70. It is basically consistent with the analysis data of the 'dynamic positions during leg swinging' (the ratio of the elbow support point height to body height is 0.65-0.75). Whether in static support positions or during dynamic leg swinging, all test subjects report that supporting on both sides is more comfortable than supporting in front of the chest and it provides better leverage. The weight measurements in static support positions are basically within the range of the weight measurements during dynamic leg swinging. The ratio of maximum weight reduction while two arms on each side of the body to body weight is between 0.10 and 0.66, and the ratio of minimum weight reduction while the user has two arms on each side of the body to body weight is between 0.08 and 0.36. The ratio of maximum weight reduction while on support of two arms in front of the chest weight is between 0.03 and 0.49, and the ratio of maximum weight reduction while two arms in front of the chest to body weight is between 0 and 0.22. The values of the model parameters $\alpha$, $\beta$, $\gamma$, $\delta$ are calibrated and adjusted based on the values of S, N, Q, T to ensure that k4=0 under the condition that the user feels comfortable and the limits of supporting leg load reduction is met; k4=1 when the user feels uncomfortable or the limits of supporting leg load reduction is not met. The formula used for calculating the comfort indicative value in this invention embodiment is $k4=\text{round}(0.25Q+0.28S+0.15T+0.18N)$.

The treatment process control module matches the movement quantity, movement frequency and movement amplitude collected by the motion quantity data collection component with the corresponding values in the user's treatment model, and calls the corresponding feedback instructions in the feedback information storage module based on the matching results. When the user's CCR data conforms to the CCR analysis model, it records the movement as an effective one and triggers the corresponding feedback information. When the movement quantity conforms to the user's treatment model, it triggers the corresponding feedback information. When the quantity data of effective movements conforms to the user's treatment model, it triggers the corresponding feedback information, guiding the user to complete the daily treatment and rehabilitation exercise as prescribed by the treatment model. After the user completes a stage of treatment and rehabilitation exercise, the treatment process control module imports the next level of graduated treatment model. The feedback instructions include count standard feedback information, CCR standard feedback information, incentive feedback information, separation alarm information, and media information. The separation alarm information includes human-machine separation alarms and components-separated alarms. The human-machine separation alarm is used to remind the user to exercise as scheduled, by sounding an alarm at a preset time or/and voicing alarm information in accordance with the length of time the user being out of exercise. The components-separated alarm alarms when different components are placed too far apart to prevent loss of components. Multi media information is developed to help relieve restlessness of the user, including but is not limited to music, videos, online messages, video calls and live chat rooms.

Figure 3:
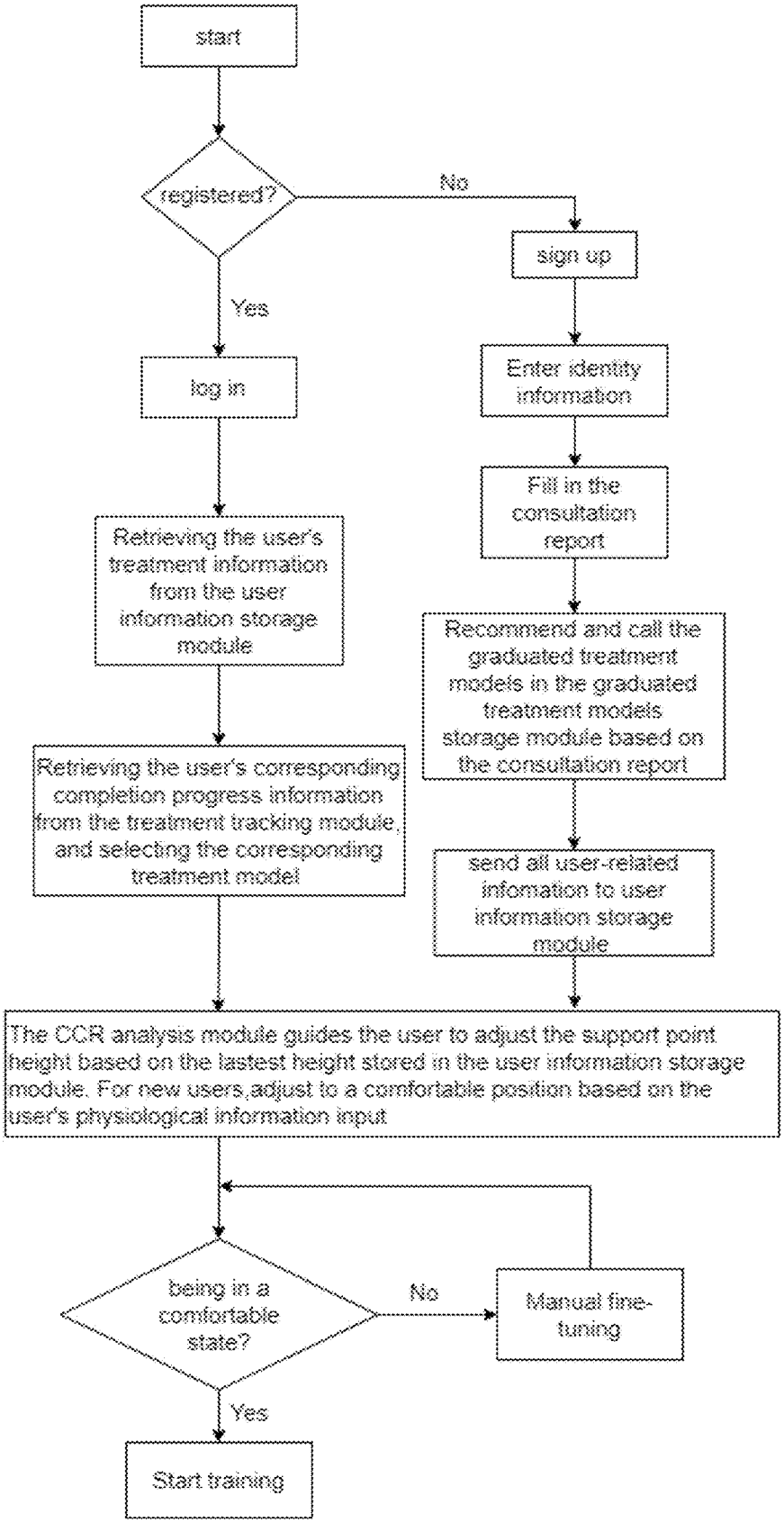
FIG. 3 is workflow diagram of the treatment training pre-processing.
Figure 4:
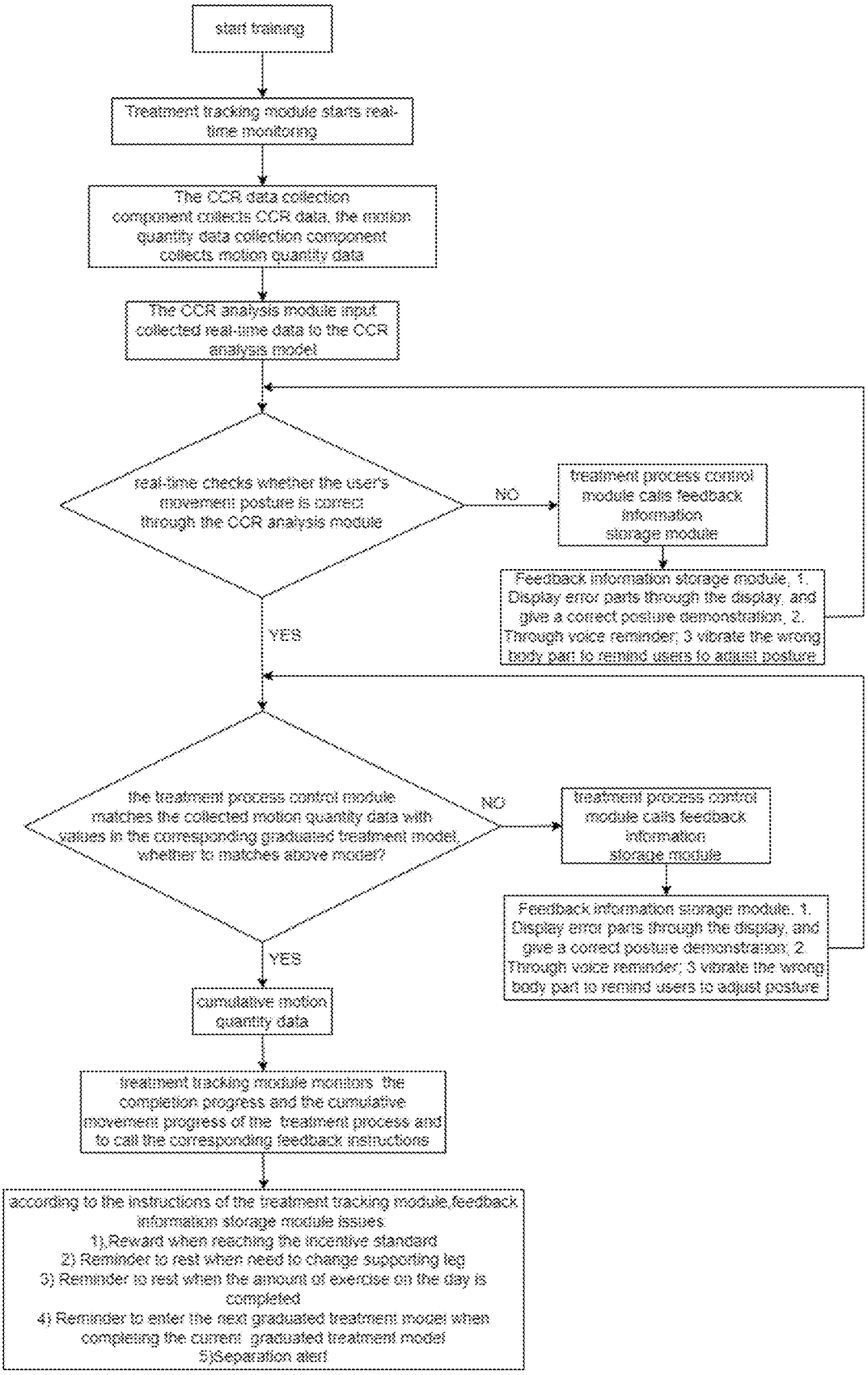
FIG. 4 is workflow diagram of the treatment process control module.
Figure 5:
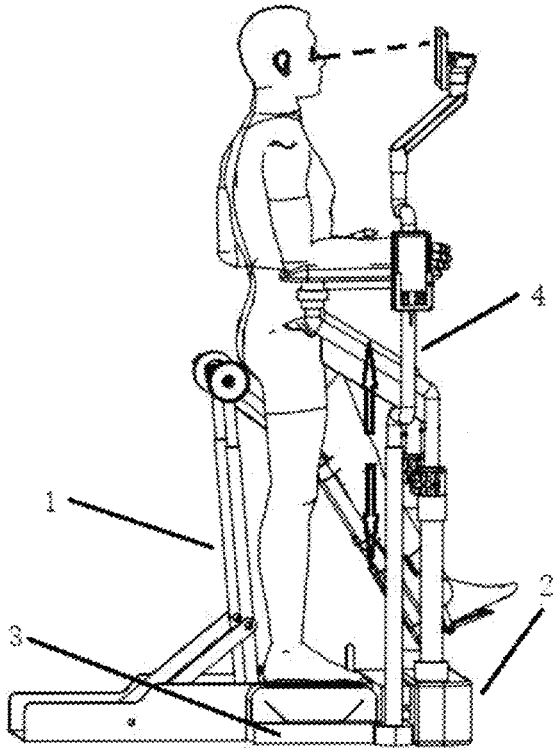
FIG. 5 is right side view of the device in operation.

The workflow of the treatment process control module is shown in FIGS. 3 and 4, among which, the pre-exercise steps include:

Verifying the user's identity information, guiding him to log in to an account or to create an account, calling the user's treatment information from the user information storage module and the user's corresponding completion progress information from the treatment tracking module, and selecting the corresponding treatment model for degenerative knee joint disease from the treatment model storage module;

2) The CCR analysis module guides the user to adjust the elbow support point height and the lower leg length adjustment frame in the support component based on the support point height and data of weight reduction (as a result of being on support) stored in the user information storage module. For new users, the elbow support point height and the lower leg length adjustment frame in the support component are adjusted to a comfortable position based on the user's physiological information input.

3) Guide the user to start training in a comfortable state.

The steps of the training phase include:

1) The CCR data collection component collects CCR data, the motion quantity data collection component collects motion quantity data, and all data so collected are inputted to the CCR analysis model. The CCR analysis model calculates the user's movement posture based on the CCR data. When the CCR indicative value y is 1, it outputs the corresponding feedback command, displays on the monitor corresponding positions and pictures of correct postures.

If the upright posture indicative value k1 is 1, it outputs the voice message 'Please stand straight'; if the straight leg indicative value k2 is 1, it outputs the voice message 'Your leg is not straight, please stretch your leg straight and swing it'; if the supporting leg load reduction indicative value k3 is 1, it outputs the voice message 'The pressure on your leg is too high, please adjust the elbow support to reduce the weight'; if the comfort indicative value k4 is 1, it outputs the voice message 'Are you feeling uncomfortable? Please adjust your posture.' The device prompts the user to make corrections to his posture, among other methods, by vibrating at incorrectly placed body parts.

(2) Real-time collect and record user motion quantity data and/or motion posture data, calling feedback instructions from the feedback information storage module to guide the user to complete standardized exercises. When the times of supporting the body on one leg V meets the standard, it outputs the voice message 'Please switch legs' or 'The supporting leg needs to rest'; When the rest time is shorter than the necessary supporting leg rest time 1, it outputs the voice message 'The supporting leg needs to rest, please wait'; if the movement amplitude $\varphi$ does not meet the standard, it outputs the voice message 'The leg swing amplitude is not enough'; when the movement quantity of leg swinging cycles reaches a hundred, it outputs feedback information of encouragement, in forms of voice messages and sole massage.

(3) The motion process control module compares motion quantity data collected from the user with corresponding prescriptions of the user-specific treatment model until the former falls within the range of the latter.

(4) Store user motion quantity data and/or motion posture data, update the user's treatment information and the corresponding user's completion progress information in the treatment tracking module, and call the feedback instructions from the feedback information storage module to guide the user to end the process.

Optionally, the support component includes: folding leg swing mechanism 1, the multifunctional support frame 2, a multifunctional support adjuster 3, a terminal support frame 4, and a display 5. The CCR data collection component and the motion quantity data collection component are installed on the support component, and the control component is integrated into the display 5, as shown in FIGS. 5, 6, 7, 8, 9, 10, 11, 12, 13, 16, 17, 18. The multifunctional support frame 2 is used to support the user's elbows and is fixedly connected to the folding leg swing mechanism 1.

Figure 6:
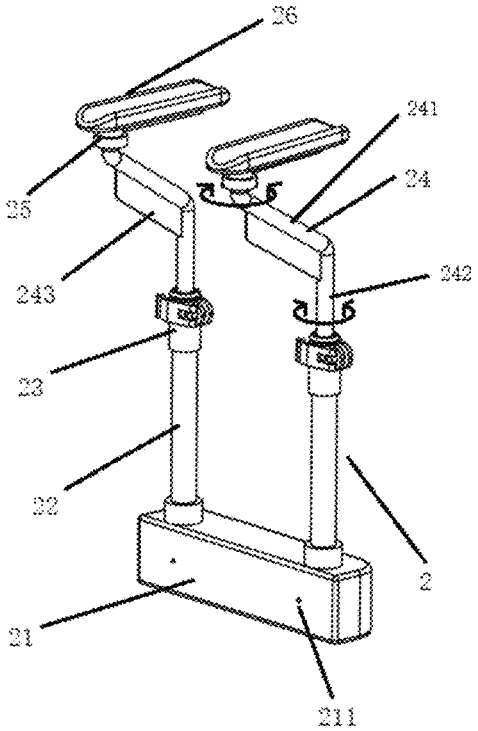
FIG. 6 is assembly structure diagram of the multifunctional support frame.
Figure 7:
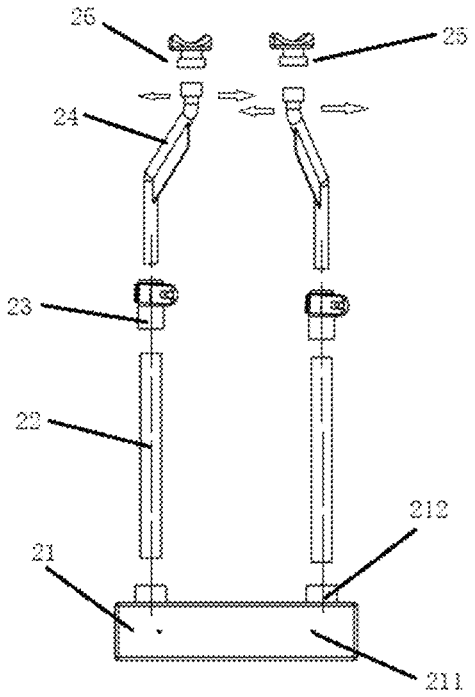
FIG. 7 is exploded view of the parts of the multifunctional support frame.

Optionally, as shown in FIGS. 6 and 7, the multifunctional support frame 2 includes a support base 21, two support rods 22 and two elbow and armpit dual-use support bracket 26 which are paired. The support base 21 has guide rail mounting holes 211 for installing the multifunctional support adjuster 3 and support rod fixing holes 212 for connecting the support rods 22. One end of each of the two support rods 22 is fixedly connected to the support base 21 through the support rod fixing holes 212 and, relative to the center-line of the support base 21, the rods are symmetrically arranged. The elbow and armpit dual-use support brackets 26 are pivotally connected to the other ends of the rods 22, and the pivot axis of the brackets 26 are perpendicular to the pedal surfaces 121. As an example of embodying the invention, while the user is performing leg swing exercise in a standing position, he can rest his elbows or armpits on the two elbow and armpit dual-use support brackets 26 to ensure body balance and reduce the weight borne by the standing leg. One end of each of the elbow and armpit dual-use support brackets 26 is pivotally connected to one end of the support rods 22; and by rotating the elbow and armpit dual-use support brackets 26, the space between the elbow and armpit dual-use support brackets 26 can be adjusted to accommodate different user shoulder widths, which enhances further user comfort.

Optionally, the treatment and rehabilitation device also includes two cam locking rings 23 and two support adjustment rods 24 each of which matches with one of the elbow and armpit dual-use support brackets 26. Each of the support adjustment rods 24 includes a third rod body 241 and a fourth rod body 242. One end of the third rod body 241 is pivotally connected to the matching elbow and armpit dual-use support bracket 26, while the other end of the third rod body 241 is connected to one end of the fourth rod body 242. The other end of the fourth rod body 242 is pivotally connected to the other end of the support rod 22 through the cam locking ring 23, and the pivot axis of the fourth rod body 242 is perpendicular to the pedal surface 121. The third rod body 241 and the fourth rod body 242 are arranged at a right angle or obtuse angle, with the second reinforcing flange 243 set between them to enhance stability. As an example of embodying the invention, a support adjustment rod 24 in the form of a folded rod is placed between the elbow and armpit dual-use support bracket 26 and the support rod 22. The elbow and armpit dual-use support bracket 26 is pivotally connected and locked to the third rod body 241 through the support bracket locking ring 25. While adjusting the rotation of the elbow and armpit dual-use support bracket 26 relative to the third rod body 241, the rotation of the fourth rod body 242 relative to the support rod 22 can also be further adjusted, and the fourth rod body 242 can ultimately be locked in place by the cam locking ring 23. This further expands the adjustment range of the elbow and armpit dual-use support bracket 26, making it more possible to accommodate different needs and deliver comfort.

As an example of embodying the invention, by adjusting the depth at which the fourth rod body 242 is inserted into the support rod 22, the overall height of the elbow and armpit dual-use support bracket 26 can be adjusted accordingly, making it more possible to accommodate users of different heights.

Figure 8:
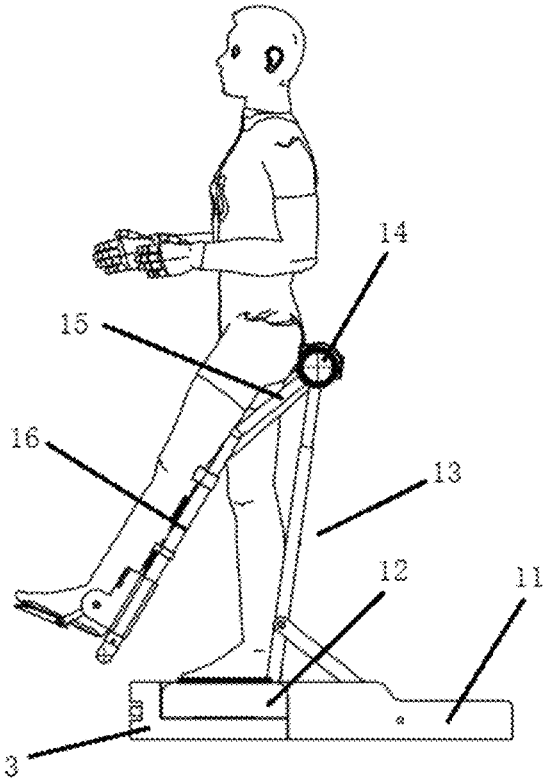
FIG. 8 is left side view of the folding leg swing mechanism in operation.

As shown in FIG. 8, the folding leg swing mechanism 1 includes a housing 11, a foot pedal 12, a folding telescopic frame 13, a motor 14, a swing angle frame 15, and a lower leg length adjustment frame 16. The foot pedal 12 is mounted on the housing 11 and has a pedal surface 121 for the user to stand on. The folding telescopic frame 13 and the swing angle frame 15 are both rod-shaped. One end of the folding telescopic frame 13 is connected to the housing 11, and the other end of the folding telescopic frame 13 is hinged to one end of the swing angle frame 15 via a pivot 1*a*, which is parallel to the pedal surface 121. The motor 14 is mounted at the other end of the folding telescopic frame 13 and connected to the pivot 1*a* to provide it with driving force. The motor 14 is electrically connected to the control component. The other end of the swing angle frame 15 is connected to the lower leg length adjustment frame 16, which has a footrest plate 165*a* on it for supporting the foot.

Figure 10:
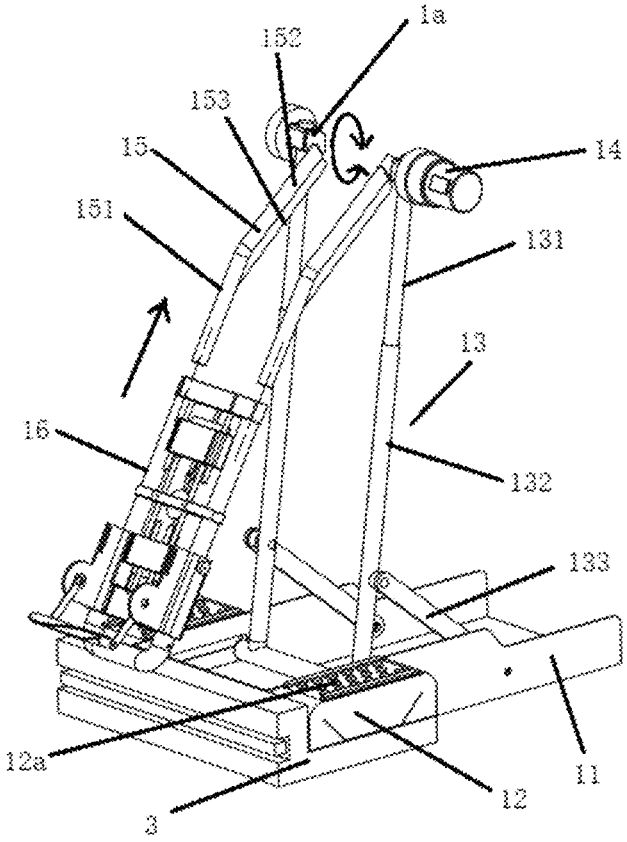
FIG. 10 is schematic diagram of the combination principle of the folding leg swing mechanism.

Optionally, as shown in FIG. 10, the swing angle frame 15 includes a first rod body 151 and a second rod body 152. One end of the first rod body 151 is connected to the lower leg length adjustment frame 16, and the other end of the first rod body 151 is connected to one end of the second rod body 152. The other end of the second rod body 152 is hinged to the other end of the folding telescopic frame 13, and the first rod body 151 and the second rod body 152 are arranged at an obtuse angle. As an example of embodying the invention, the swing angle frame 15 consists of the first rod body 151 and the second rod body 152 arranged in an obtuse included angle. As an example of embodying the invention, the obtuse included angle range is from 150° to 160°, and first reinforcing flange 153 is provided between the included angles to enhance stability. Since the thigh and the lower leg can not remain completely straight at all times, arranging the first rod body 151 and the second rod body 152 at an obtuse angle can make it better fit the human body's configuration, reduce interference from the swing angle frame 15 and the inside and outside of the thigh, and render the hip joint as close as possible to the pivot 1*a* during exercise, thereby improving the comfort standard of the embodiment.

As an example of embodying the invention, the folding leg swing mechanism 1 includes two folding telescopic frames 13, two swing angle frames 15. Two sets of swing mechanisms, each of which is composed of a swing angle frame 15 and lower leg length adjustment frame 16, jointly drive the lower leg length adjustment frames 16 into pendulum motion. This design improves the structural stability of the embodiment.

Figure 11:
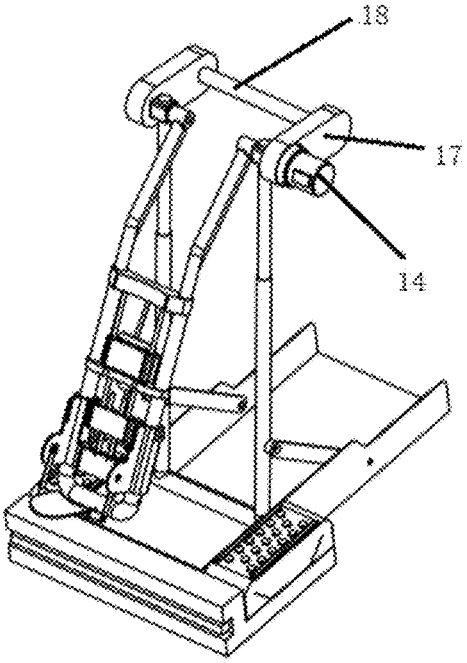
FIG. 11 is schematic diagram of the principles and structure of the dual-drive version of the folding leg swing mechanism.

In this exemplary embodiment of the present invention, there is a problem of poor stability when using the motor 14 to drive the corresponding swing angle frame 15. As shown in FIG. 11, it is viable to add two gear cases 17 respectively at the places where the other end of the two folding telescopic frames 13 are hinged to the swing angle frames 15, and connect the power of the two gear cases 17 through the coupling 18. The coupling 18 can be installed in a sleeve between the two gear cases 17 for better concealment and protection. In this configuration, only one motor 14 is needed to drive the pivot 1*a* at the hinge where the swing angle frames 15 meet their counterpart folding telescopic frames 13. The motor 14 transfers power to the gear case 17 on one side and then, through the coupling 18, the power is transmitted to the swing angle frame 15 on the other side. With the power on both sides being thus synchronized, this embodiment works two-drive on both left and right sides with enhanced in-motion stability of the swing angle frame 15. When the coupling 18 moves backward, the pivot center of the swing angle frame 15 remains stationary. This consequently brings the pivot center of the swing angle frame 15 further closer to the hip joint, makes the trajectory of the swing angle frame 15 more consistent with the that of leg swinging, improving the comfort standard experienced by the user in the process of the rehabilitative exercise and ensuring smooth forward and backward swinging motion of the legs.

Figure 9:
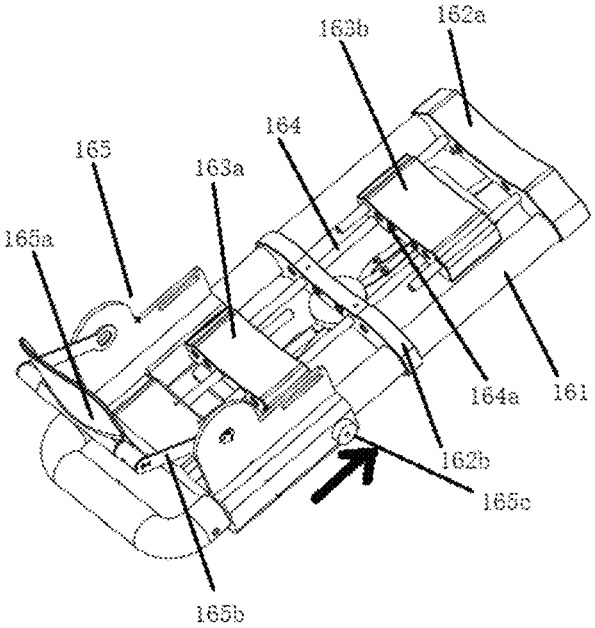
FIG. 9 is assembly structure diagram of the lower leg length adjustment frame.

Optionally, as shown in FIG. 9, the lower leg length adjustment frame 16 includes a U-shaped frame 161, a guide rod 164, and a first slider 165. One end of the U-shaped frame 161 is connected to the first rod body 151 in a detachable manner. The guide rod 164 is set on the U-shaped frame 161 and parallel to the first rod body 151. The first slider 165 has a first guide hole 164*a*, and it can be mounted on the U-shaped frame 161 in a slide and connected to the guide rod 164 through the first guide hole 164*a*.

The footrest plate 165*a* is mounted on the first slider 165, and the first slider 165 also has a locking mechanism 165*c* for connection in a fixed way with the U-shaped frame 161. Illustratively, as shown in FIG. 10, in this embodiment of the present invention, the lower leg length support frame 16 is connected to the two swing angle frames 15's first rod body 151 through the frame bodies on both sides of the U-shaped frame 161. The footrest plate 165*a* installed on the first slider 165 can be slid along the length of the guide rod 164 on the U-shaped frame 161 to adjust its relative position with the U-shaped frame 161, to accommodate the leg length of users of different heights. After adjusting to the user's comfortable foot position, the first slider 165 is fixedly connected to the U-shaped frame 161 through the locking mechanism 165*c*, completing the adjustment and fixation of the footrest plate 165*a* position, further enhancing the user's comfort during use.

Illustratively, in this embodiment of the present invention, the lower leg length adjustment frame 16 also includes a first securing frame 162*a*, a third slider 163*b*, a second securing frame 162*b*, and a second slider 163*a*. The first securing frame 162*a*, the third slider 163*b*, the second securing frame 162*b*, the second slider 163*a*, and the first slider 165 are arranged along the length of the guide rod 164 and are all provided with guide holes for connecting the guide rod 164. The first securing frame 162*a* and the second securing frame 162*b* are fixedly connected to the U-shaped frame 161, and the positions of the third slider 163*b* and the second slider 163*a* can be adjusted by sliding relative to the U-shaped frame 161 along the length of the guide rod 164, in order to provide support for the user's calf and to do this with enhanced comfort.

In FIG. 9, the folding leg swing mechanism 1 is in its longest state, and the first slider 165 can slide in the direction indicated by the arrow to adjust and accommodate the length of the lower leg. When the first slider 165 reaches the second slider 163*a*, the second slider 163*a* and the third slider 163*b* move in opposite directions under the action of the linkage. The sliders and securing frames serve as support for the calf. The first slider 165 has a locking mechanism 165*c*; and when the first slider 165 slides on the U-shaped frame 161 to the position where the user feels comfortable, it can be locked in place by the locking mechanism 165*c*.

Illustratively, in this embodiment of the present invention, a plate linkage 165*b* is used to connect the footrest plate 165*a* with the first slider 165, as shown in FIGS. 7, 8, and 9. One end of the plate linkage 165*b* is connected to the footrest plate 165*a* through a torsion spring, and the other end of the plate linkage 165*b* is connected to the first slider 165 through a torsion spring. The rotation shafts at both ends of the support plate link 165*b* are parallel to the pivot 1*a*. The footrest plate 165*a* expands when subjected to pressure from the foot. By applying the above-mentioned dual adjustable pivot design for the footrest plate 165*a* and the first slider 165, on account of the fact that the rotational centers of the human hip and the swing angle frame 15 cannot be completely coaxial, there is deviation in the trajectories of the foot swinging during exercise and the lower leg support frame. The footrest plate 165*a* installed in this configuration can rotate in real time according to the trajectory of the foot during swinging, avoiding effects of pressing and pulling on the foot due to out-of-sync trajectories. After exercise, the footrest plate 165*a* can be reset under the action of the torsion spring, which further raises the user's comfort standard.

Figure 12:
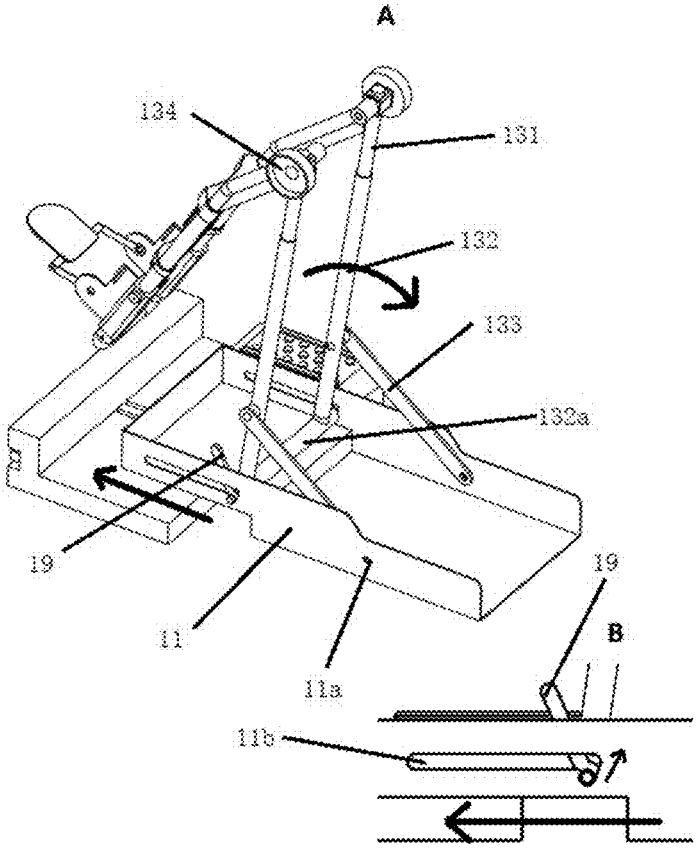
FIG. 12 is schematic diagram of the folding, stretching and retracting principle of the folding leg swing mechanism and the multi-functional support adjuster.

Illustratively, in this embodiment of the present invention, as shown in FIGS. 10 and 12, the folding telescopic frame 13 includes a telescopic rod 131, a folding frame 132, and an housing linkage 133. As can be seen from the perspective view A in FIG. 12, one end of the telescopic rod 131 is hinged to the Swing angle frame 15 through the pivot 1*a*, and the other end of the telescopic rod 131 can be telescopically inserted into the folding frame 132. The housing 11 comes with pivot holes 11*a* on its body which are used to connect the housing linkage 133; and the axes of pivot holes 11*a* are parallel to the pivots 1*a*. One end of each of the housing linkages 133 is connected to the corresponding pivot hole 11*a* through rotation shafts, and the other end of each of the housing linkages 133 is hinged to the middle of the corresponding folding frame 132, with the hinge axes of the other end of the housing linkages 133 being arranged respectively parallel to their corresponding pivot 1*a*. The housing 11 also has housing linkage-fastening holes 11*b* parallel to the pedal surfaces 121, and one end of the folding frames 132 is to be mounted by a slide into the housing linkage-fastening holes 11*b* through the linkage pivot 132*a*. Seeing in combination of the perspectives views A and B, it is known that two housing linkage-fastening holes 11*b* are symmetrically arranged on both sides of the housing, and the axes of the folding frames 132 pass through the length and in the middle of the frame bodies and lead to the housing linkage-fastening holes 11*b* on the upper sides of the housing. By sliding the linkage pivot 132*a* of the folding frame 132 in the housing linkage-fastening holes 11*b*, the folding telescopic frame 13 can be folded and stored in the housing 11, as shown in perspective view B of FIG. 12, and locked in place by the locking handle 19 on the linkage pivot 132*a*, thus the folding leg swing mechanism 1 is folded for convenient storage and easy carrying.

Figure 13:
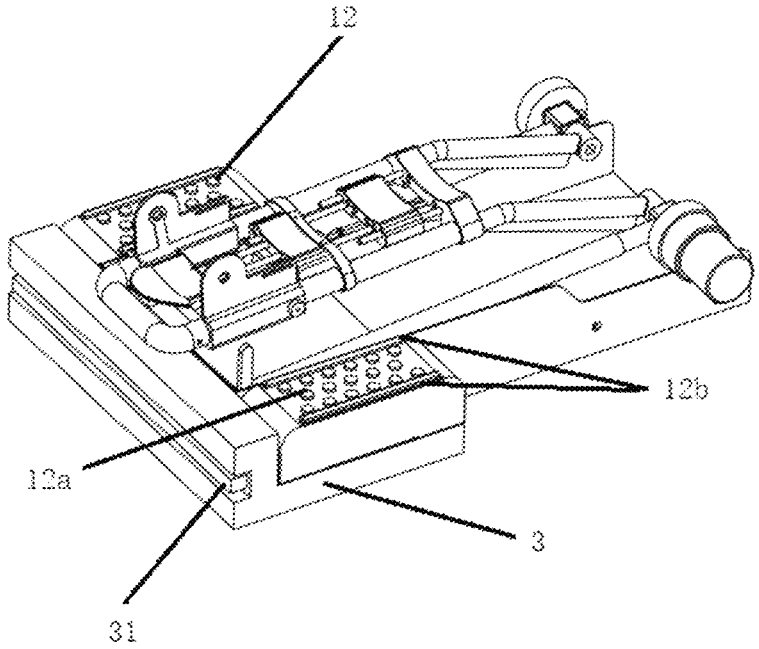
FIG. 13 is schematic diagram of the status of the folding leg swing mechanism when folded.

Illustratively, in this embodiment of the present invention, FIG. 13 shows the folded state of the folding leg swing mechanism 1. On the foot pedal surfaces 121 of the foot pedals 12 are massage protrusions 12*a* being arranged in even intervals; and on both sides of the foot pedal surfaces 121, anti-slip protrusions 12*b* are arranged; these protrusions provide both massaging and anti-slip effects for the user when he/she steps on the foot pedal 12, keeping the user from slipping and improving the safety and comfort standard of this therapeutic and rehabilitative device.

Figure 14:
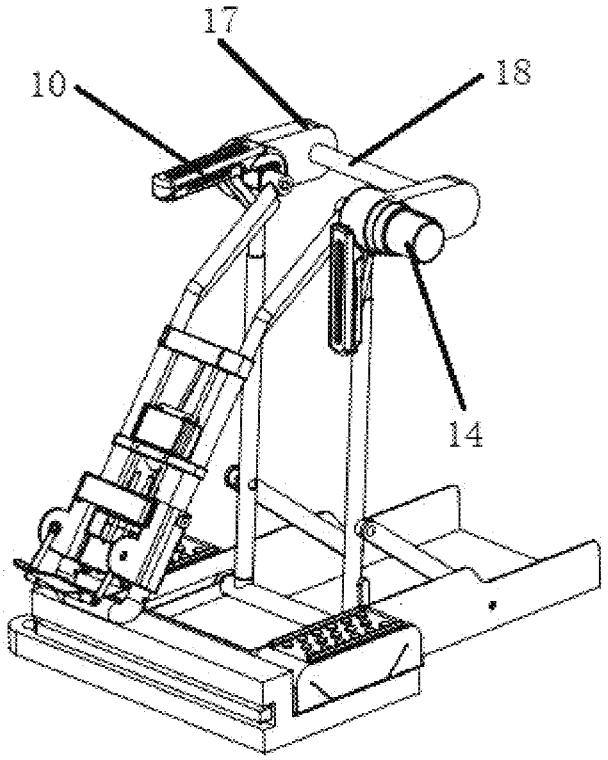
FIG. 14 is schematic diagram of the principle and structure of the dual-drive version of the folding leg swing mechanism with a flip-folding seat.
Figure 15:
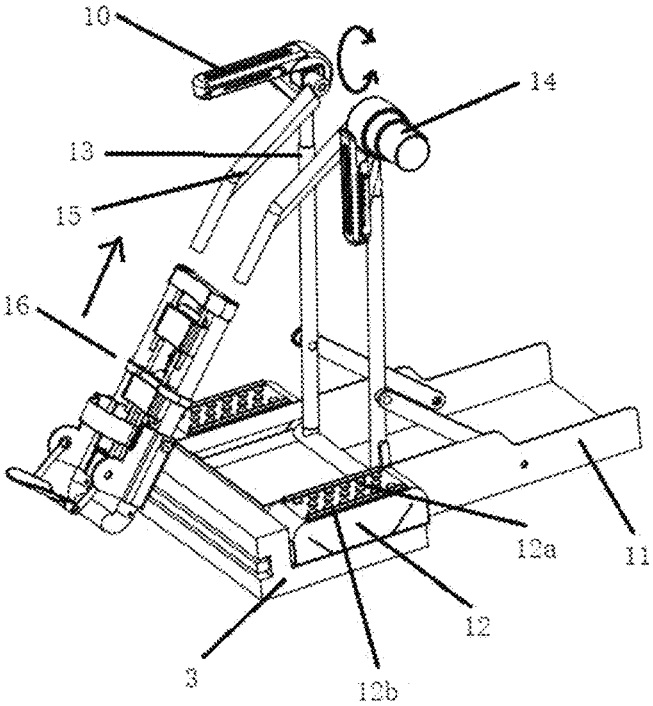
FIG. 15 is schematic diagram of the principle and structure of the folding leg swing mechanism with a flip-folding seat.

Optionally, as shown in FIG. 14, this therapeutic and rehabilitative device also includes a flip-folding seat 10, which is pivotally connected to the other end of the folding and telescopic frame 13; and the pivot axis of the flip-folding seat 10 is coaxial with the pivot 1*a*; and the flip-folding seat 10 is used to support the user's buttocks. In another example of possible implementations, as shown in FIG. 15, a flip-folding seat 10 which is pivotally connected is set at the other end of the folding and telescopic frame 13. For users with difficulty to stand, the flip-folding seat 10 can be rotated around the pivot 1*a* to a horizontal position to provide auxiliary support for the user's buttocks during exercise, allowing the user to perform the leg swinging movements in a seated position and thus further improving the practicality of this therapeutic and rehabilitative device.

Figure 16:
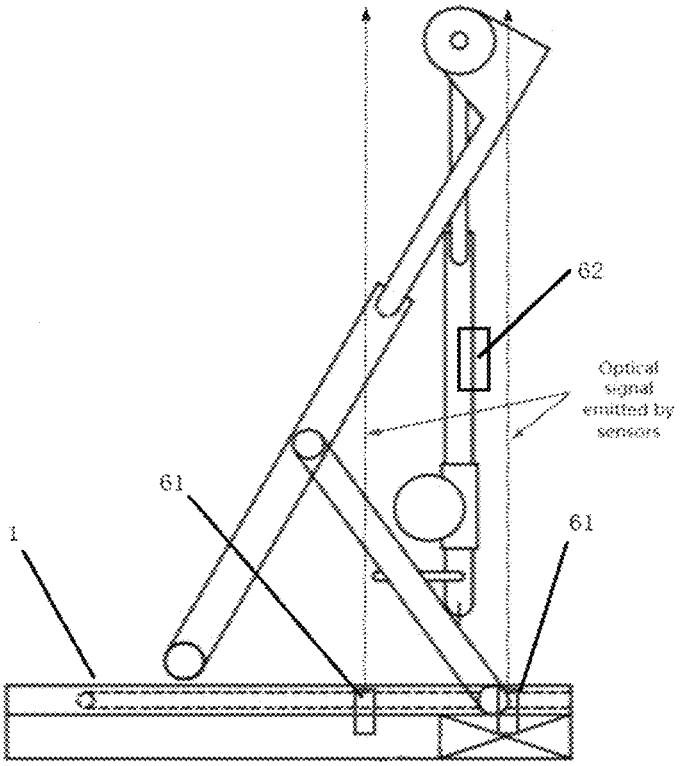
FIG. 16 is left side view of the installation position of the photoelectric sensor.
Figure 17:
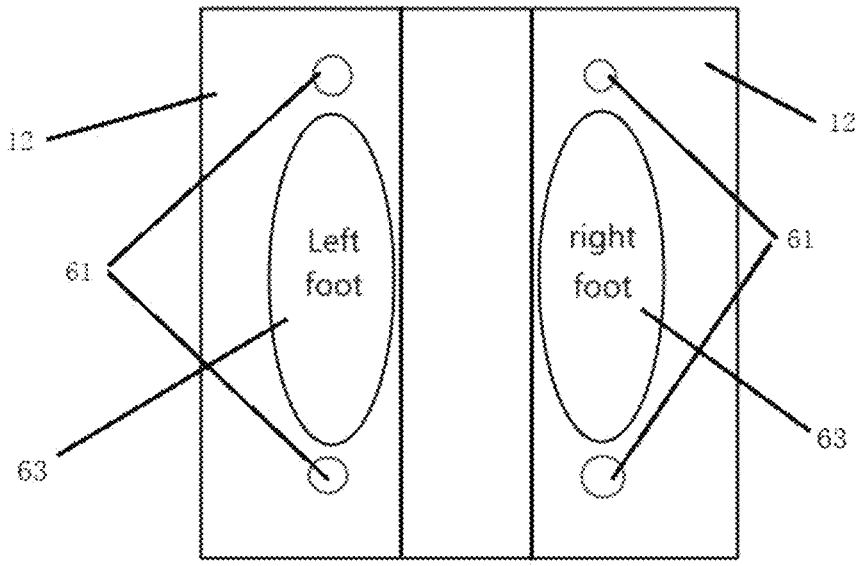
FIG. 17 is top view of the installation position of the photoelectric sensor.

Illustratively, in the present embodiment of the invention, the CCR data collection component includes the first sensor group 61, the second sensor group 62, and the third sensor group 63, used to collect the CCR data of the user in use, and the motion quantity data collection component includes the fourth sensor group 64 used to collect the user's motion data in use. The CCR data collection component and the motion data collection component are both electrically connected to the control component. The first sensor group 61 includes photoelectric sensors set in front and behind the foot pedals 12 of the support component, as shown in FIG. 16, with the receiving end of the photoelectric sensor vertically positioned above the two transmitting ends. When the user performs leg swinging exercise, if the receiving end receives the photoelectric signal which is not blocked by the user, the output for trunk upright status value is 0, k1=0. When the receiving end does not receive the photoelectric signal due to it being blocked by the user, the output for the upright trunk status value is 1, k1=1. The two sets of photoelectric sensors are respectively assigned to eye the left and right feet, and the distance between them can be adjusted according to practical requirements. The sensors transmit photoelectric signals upwards in vertical direction. When the user is in the position of standing upright, when a person is in an upright position, the transmitted signals will not be blocked by the body. When the user is in a bent position, the signals transmitted by the sensors will be blocked by the body; and the sensor can detect the signals reflected back, thereby determine the presence of an obstacle and then determine that the body is not upright; in this case, it outputs k1=1. If no reflected signal is detected, it determines that the body is in an upright state; in this case, it outputs k1=0. There are four sensors for observing leg swinging in an upright position, and the installation diagram is shown in the top-view FIG. 17. When a person stands on the left foot and swings the right, if the sensor on the left side does not detect a reflected signal, it indicates that the left leg is upright. If the sensor on the right side detects reflected signals that are periodically changing, it indicates that the right leg is swinging. If the sensor on the right side does not detect any reflected signal, it indicates that the right leg is in an upright position. It is important to note that the beam angle of the sensor signal is very narrow. If a person is in a bent or hunched position, the transmitted signal can be reflected back and detected by the sensor, thus it can be determined that the person is not in an upright position.

Figure 18:
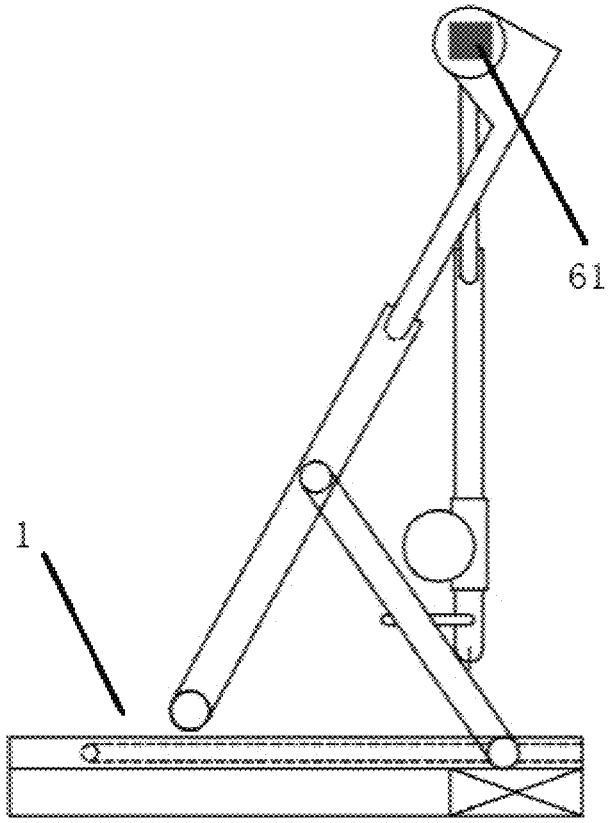
FIG. 18 is schematic diagram of the installation position of the TOF sensor.

The first sensor group 61 can also be implemented by setting up a TOF sensor at the top pivot 1*a* of the folding telescopic frame 13 on the folding leg swing mechanism 1, which shoots searching signals towards the upper part of the human body, as shown in FIG. 18. It shoots searching signals towards the upper body of the human (as shown in the figure) and collects depth signals of this part of the space (the line formed by the closest distance to the TOF sensor). When the TOF sensor collects a depth signal perpendicular to the ground, the body is in an upright position, and the output for the upright trunk status is 0, k1=0. If the collected depth signal is not perpendicular to the ground, it indicates that the upper body is in a bent position and not upright, and the output for the upright trunk status is 1, k1=1. The TOF sensor is mainly responsible for detecting whether the upper body is upright. Whether the thighs and calves are upright can still be detected by the four photoelectric sensors installed at the foot pedal position. The photoelectric sensors detect whether there are obstructions below the thighs. If the photoelectric sensors detect an obstruction, it indicates that the thighs and calves are in a bent position and not upright.

The second sensor group 62 includes displacement sensors placed on the lower leg length adjustment frame 16 corresponding to the back of the user's knees, as shown in FIG. 16. The displacement sensors continuously collect the fitting status of the user's legs with the lower leg length adjustment frame 16. When the legs are fitted to the frame, the output for the upright status of the legs is 0, k2=0. When they are not, the output for the upright status of the legs is 1, k2=1.

Figure 19:
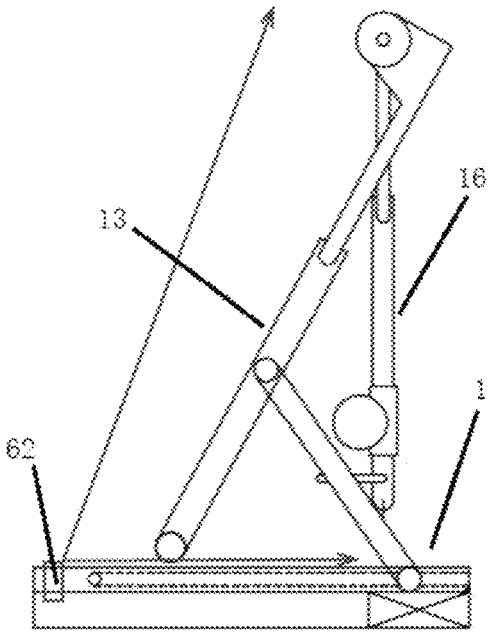
FIG. 19 is schematic diagram of the camera installation position.

Through a camera, the second sensor group 62 can be implemented as follows: as shown in FIG. 19, the camera is installed at the front of the support component to recognize the user's posture and movements. The control system can recognize the user's posture and movements by the 'Openpose' system. When the user is performing leg swing exercises, the camera can identify whether the exerciser is doing upright leg swings, and output the upright trunk status value and leg upright status value.

The third sensor group 63 includes weight sensors set below the foot pedals of the support component, as shown in FIG. 18, to real-time collect the user's weight data. The method for calculating the supporting leg load reduction indicative value is based on whether the ratio of the supporting leg load reduction while on support of two sides of the body to body weight, S for short, or the ratio of the supporting leg load reduction while on support of the chest front to body weight, N for short, is within the range of the supporting leg load reduction in the given graduated treatment model, Aa for short. If it is within the range, the output is k3=0; otherwise, the output is k3=1.

Figure 20:
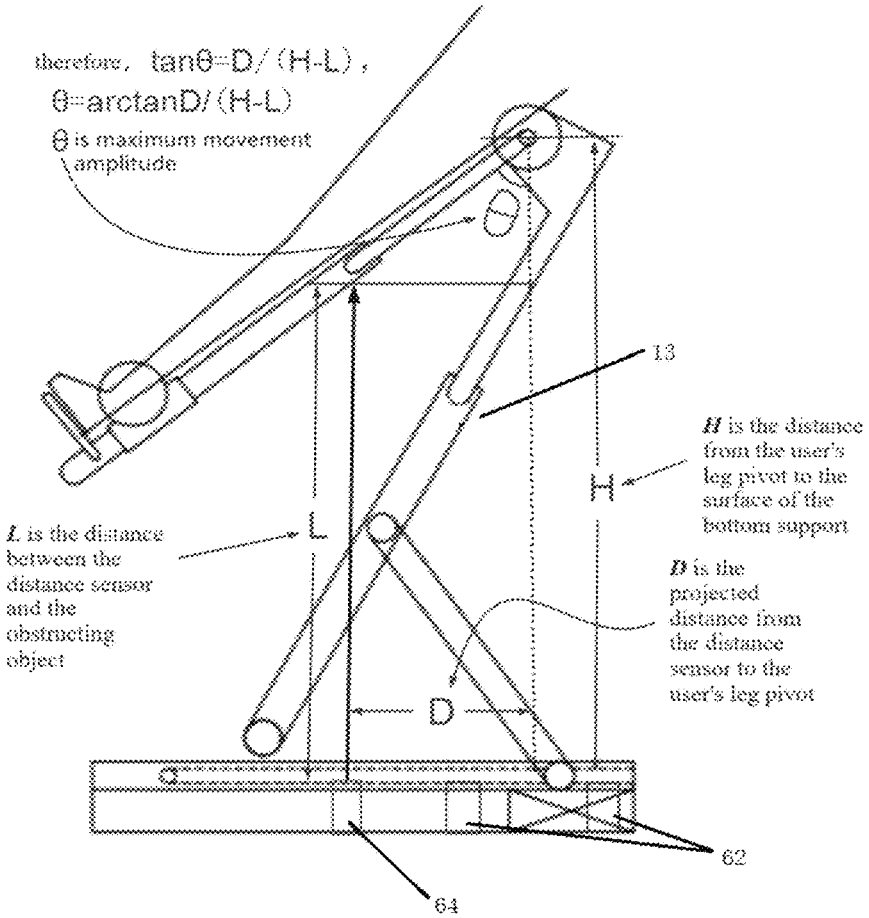
FIG. 20 is schematic diagram of the installation position of the distance sensor and the angle calculation principle.

The fourth sensor group 64 includes photoelectric sensors on the side of the housing 11 (which can be reused with the first sensor group 61) and distance sensors. When measuring the movement amplitude of the leg swinging, as shown in FIG. 20, the movement n amplitude $\theta=\arctan(D/(H-L))$, where H is the distance from user's leg pivot point to the surface of the foot pedal, L is the distance between the distance sensor and the obstructing object, and D is the projected distance from the distance sensor to the user's leg pivot. In this embodiment, in order to accurately measure the value of D, the greater trochanter, which is the user's leg pivot point, is not easy to arrange the measuring point, so the measuring point is arranged on parallel pivot 1*a*.

If you want the function of measuring swing amplitude, an angle sensor can also be installed at the pivot of the device. It can measure the swing range of the device and thereby the swing amplitude θ can be obtained. When measuring the movement quantity of leg swings made by the user, the photoelectric sensor records the movement quantity and the movement frequency by detecting the periodic changes in the signals.

The control component is configured to control the motor 14 according to the type of leg assistance F prescribed in the particular graduated treatment model, driving the swing angle frame 15 to rotate. When the leg assistance force F in the graduated treatment model is a complementary driving force, the motor 14 drives the swing angle frame 15 to rotate. When the leg assistance F is the primary driving force, the motor 14 does not provide power to the swing angle frame 15 and it is the user's leg which drives the swing angle frame 15 to rotate. When the leg assistance F is a resistance force, the motor 14 provides reverse power to the swing angle frame 15, and the user overcomes the resistance by working the leg and thereby drives the swing angle frame 15 to rotate.

Figure 21:
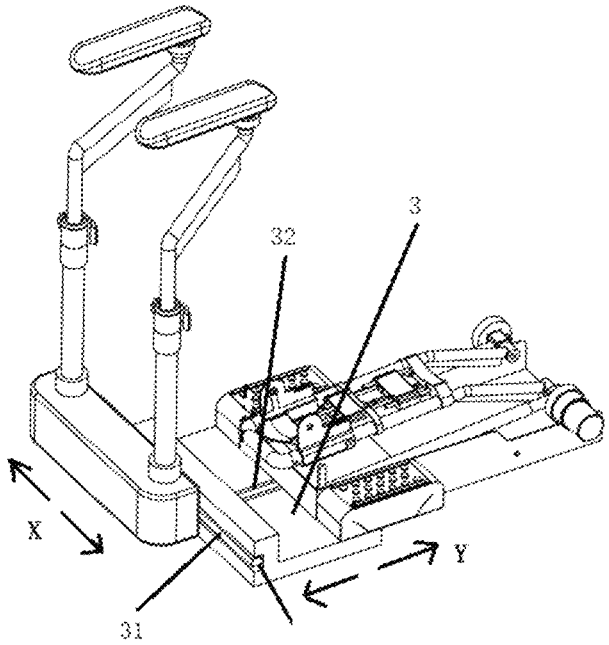
FIG. 21 is schematic diagram of the working principle of the multi-functional support adjuster.

Optionally, as shown in FIG. 21, this therapeutic and rehabilitative device also includes a multifunctional support adjuster 3 which is connected to the housing 11. The multifunctional support adjuster 3 has a first guide rail 31 parallel to the pivot 1*a*, and the support base 21 can be connected to the first guide rail 31 through a sliding groove. The folding leg swing mechanism 1 includes two foot pedals 12 symmetrically arranged with respect to the lower leg length adjustment frame 16. Illustratively, in this embodiment of the present invention, by setting a foot pedal 12 on each side of the folding leg swing mechanism 1, the user can, based on his/her own needs, either stand on the left leg on one foot pedal 12 and work the right leg to do swinging exercise on support of the lower leg length adjustment frame 16, or stand on the right leg on the other foot pedal 12 and use work the left leg to do swinging exercise on support of the lower leg length adjustment frame 16. During swinging exercise with the right leg, the position of the support base 21 can be adjusted along the length of the first guide rail 31 to move the multifunctional support frame 2 into positions to the left of the multifunctional support adjuster 3 and fixedly connected to it. During swinging exercise with the left leg, the position of the support base 21 can be adjusted along the length of the first guide rail 31 to move the multifunctional support frame 2 into positions to the right of the multifunctional support adjuster 3 and fixedly connected to it. This ensures that the two elbow and armpit dual-use support brackets 26 on the multifunctional support frame 2 can be moved into a position convenient for the user to support his/her elbows and armpits, therefore improves the practicality and user comfort standard of the therapeutic and rehabilitation device.

Illustratively, in this embodiment of the present invention, the multifunctional support adjuster 3 can also be fitted with a second guide rail 32 perpendicular to the first guide rail 31, and the housing 11 can be installed on the second guide rail 32 through a sliding groove. To suit his/her own needs, the user can adjust the relative position of the housing 11 in the length direction of the second guide rail 32, thus alter the distance between the folding leg swing mechanism 1 and the multifunctional support frame 2. This helps achieve tailored adjustments of the standing space to accommodate users of different body types, and further enhances the practicality and user comfort standard of the therapeutic and rehabilitation device.

As shown in FIG. 21, during rehabilitative exercise of the left leg on the leg swing mechanism, the user's right foot steps on the right foot pedal. When the user exercises with the right leg, the left foot steps on the left foot pedal; the user has to move half a body's position to the left. Under the circumstance, the position of the multifunctional support frame 2 needs to be adjusted simultaneously to be able to provide support along the correct force line. The horizontal movement function in the X direction can solve this problem. Joint adjustments in the X and Y directions not only changes the relative support position, but also increases or decreases the user's standing space when moving in the Y direction. Therefore, the multifunctional support adjuster 3 can meet the needs of users of different heights and body types, greatly improving the device's usability.

Figure 22:
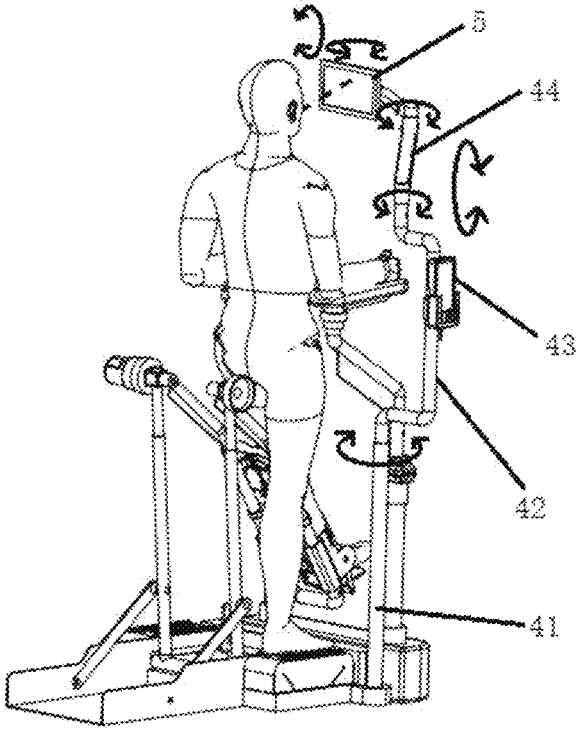
FIG. 22 is structural schematic diagram of the terminal support frame.

As shown in FIG. 22, the terminal support frame 4 includes a straight frame 41, a rotating U-shaped frame 42, and an all-direction adjustment bracket 44. The straight frame 41 is perpendicular to the foot pedal surface 121 and is fixedly connected to the multifunctional support adjuster 3 at one end. The other end of the straight frame 41 is connected to the rotating U-shaped frame 42, and the other end of the rotating U-shaped frame 42 is connected to the all-direction adjustment bracket 44. A remote control holder 43 is provided on the rotating U-shaped frame 42 for placing the device's remote control, and the other end of the all-direction adjustment bracket 44 is used to support the display 5.

When the user needs to use this therapeutic and rehabilitation device for rehabilitative exercise, he/she can stand in a single-leg stance on the foot pedal surface 121 of the folding leg swing mechanism 1, fasten the leg that needs to be exercised to the swinging structure composed of the swinging angle frame 15 and the lower leg length adjustment frame 16. The foot of the latter can step on the footrest plate 165*a* for support and positioning. While standing, the user can rest his/her elbows or armpits on the multifunctional support frame 2 to maintain balance and lighten the weight burden on the standing leg. Then, the user can perform the rehabilitative exercise either by, through his/her own strength, making the lower leg length adjustment frame 16 and swing angle frame 15 revolve together around pivot 1*a* in pendulum motion relative to the folding telescopic frame 13, or with the help of the device which controls the motor 14 to, through a control component and according to a pre-set program, drive the lower leg length adjustment frame 16 and swinging angle frame 15 into pendulum motion. Meanwhile, the first sensor group 61, the second sensor group 62, and the third sensor group 63 on the foot pedal 12 collect the user's CCR data, which includes the comfortable support height, supporting leg load reduction, trunk upright status value and upright leg status value. The fourth sensor component 64 on the housing 11 collects the user's motion data, including the movement quantity of leg swings, the frequency and amplitude of motion, and send the CCR and motion quantity data to the control component for purposes of collection and analysis. The treatment process control module in the control component will call the corresponding feedback instructions in the feedback information storage module based on the CCR judgment instructions; It matches the movement quantity, movement frequency, and movement amplitude collected by the motion quantity data collection component with the corresponding values in the treatment model, and calls the corresponding feedback instructions in the feedback information storage module based on the matching results, with a view to controlling the motor 14 to move in a certain speed and frequency. Thus, the swinging speed and amplitude of the leg are ensured to be within the appropriate range, thereby improving therapeutic and rehabilitative effects.

When the control component receives the CCR data collected by the first sensor group 61, it can also input the real-time collected CCR data into the CCR analysis model, to real-time determine the user's posture information, and to output CCR judgment instructions; When the user's CCR is found to be unsatisfactory, it simultaneously outputs an incorrectness flag.

Finally, it prompts the user through voice, video, or tactile messages to adjust the body posture up to standard in order to ensure effectiveness of the rehabilitative exercise.

The above-mentioned rehabilitative device is a decent example of embodiment of this invention. Notwithstanding, the embodiment of the invention is not subject to the above example. Any changes, modifications, substitutions, combinations, simplifications made under the rationales and principles of the present invention, are considered equivalent substitutions of the above-mentioned embodiment, and are included within the scope of protection that the present invention's is conferred upon.

What is claimed is:

1. A device for treating and rehabilitating knee osteoarthritis, the device designed based on knee osteoarthritis pendulum therapy, the therapy configured to require users to perform leg swinging movements as a treatment, the device comprising a body data collection component, a motion quantity data collection component, a support component, a control component, and a feedback component;

the support component is used to provide trunk support and/or waist support and/or elbow support for the user;

the body data collection component is installed on the support component to collect a body data of the user during use of the device, the body data comprises elbow support point height, reduction of body weight on the supporting leg, trunk upright status value, and leg upright state value;

the motion quantity data collection component is installed on the support component to collect a motion quantity data of the user's leg swinging movements during use; the motion quantity data comprises movement quantity, movement frequency, and movement amplitude of leg swinging movements;

the control component comprises preset databases and a built-in computer program, the computer program receives the body data sent by the body data collection component in real-time and determines in real-time whether the body data matches values in the preset databases, the values in the preset databases meet the requirements of the knee osteoarthritis pendulum therapy; when the body data doesn't match the values, the feedback component receives feedback instructions from the control component and communicates corresponding information to the user, to correct the user's movement posture; the preset databases comprises graduated treatment models, the computer program also receives the motion quantity data sent by the motion quantity data collection component in real-time, and guide the user to complete the treatment according to the graduated treatment models;

the feedback component is used to send audio and/or video and/or tactile signals to the user according to the feedback instructions from the control component.

2. The device of claim 1, wherein the built-in computer program comprises a graduated treatment models storage module, a body data analysis module, a treatment process control module, a treatment tracking module, a feedback information storage module, and a user information storage module;

the graduated treatment models storage module is used to store the graduated treatment models;

the body data analysis module inputs the body data into a body data analysis model preexisted in the preset databases, real-time determines whether the body data matches values in the body data analysis model, and output judgment instructions; When the body data doesn't match, the body data analysis module simultaneously outputs an incorrectness flag;

the treatment process control module is used to call the feedback instructions according to the body data judgment instructions; the treatment process control module matches the motion quantity data collected by the motion quantity data collection component with values in the graduated treatment models, and according to matching results, calls the feedback instructions; the feedback instructions are stored in the feedback information storage module;

the treatment tracking module monitors the completion degree of the treatment and call the feedback instructions accordingly;

the feedback information storage module comprises count standard feedback information, body data standard feedback information, incentive feedback information, separation alarm information, and media information;

the user information storage module stores the user's personal information, body data, and motion quantity data.

3. The device of claim 2, wherein the body data analysis model is represented by the equation $y=k1+k2+k3+k4+k5$, wherein y is the user's body data indicative value, k1 is trunk upright indicative value, k2 is leg upright indicative value, k3 is supporting leg load reduction indicative value, k4 is comfort indicative value, and k5 is redundancy indicative value;

When $y=0$, the user's body data is determined as matched, and when $y=1$, the user's body data is determined as unmatched, that is, outputting the incorrectness flag.

4. The device of claim 3, wherein a calculation formula for the comfort indicative value is $k4=\text{round}(\alpha Q+\beta S+\gamma T+\delta N)$, wherein Q is ratio of the elbow support point height to body height, when the user has two arms on each side of the body as a form of support;

S is ratio of the supporting leg load reduction to body weight, when the user has two arms on each side of the body as a form of support;

T is ratio of the elbow support point height to body height, when the user places two arms in front of the chest as a form of support;

N is the ratio of the supporting leg load reduction to body weight, when the user places two arms in front of the chest as a form of support; and $\alpha$, $\beta$, $\gamma$, $\delta$ are model parameters obtained through parameter calibration, pre-set on the basis of the body data; and 'round( . . . )' represents rounding.

5. The device of claim 4, wherein, when the comfort indicative value is determined to be 1, the control component commands the feedback component to issue audio and/or video and/or tactile signals to the user, guiding him/her in adjusting the height of the waist support and/or elbow support, or automatically adjusts the height of the waist support and/or elbow support until the comfort indicative value is determined to be 0.

6. The device of claim 1, wherein the graduated treatment models consist of X1, X2 and X3 level treatment models; each graduated treatment model has preset multiple parameters, including: graduated period, swinging times of supporting the body on one leg V, movement amplitude θ, movement frequency ω, leg assistance force F, movement quantity C, necessary supporting leg rest time t, and supporting leg load reduction Δa; wherein the movement quantity C can be calculated by using the movenet frequency ω multiplies time.

7. The device of claim 1, wherein the support component comprises a folding leg swing mechanism and a multifunctional support frame; the folding leg swing mechanism is used to support the user's torso, while the multifunctional support frame is used to support the user's elbows, and both are fixed and connected.

8. The device of claim 7, wherein the folding leg swing mechanism comprises a shell, two foot pedals, two folding telescopic frames, a motor, two swing angle frames, and a lower leg length adjustment frame;

the shell serves as a bottom support, with the two foot pedals mounted on the shell; the two folding telescopic frames vertically set above the shell are fixed by shell rods; upper ends of the two swing angle frames are respectively suspended on the folding telescopic frames to achieve back and forth swinging relative to the folding telescopic frames; lower ends of the two swing angle frames are inserted into the lower leg length adjustment frame and being fixed into a single unit; the motor is located at the upper end of one of the swing angle frames, driving the swing angle frames and lower leg length adjustment frame to swing back and forth;

the control component is configured to control the motor based on the graduated treatment models, thereby driving the swing angle frame to rotate.

9. The device of claim 8, comprises two flip-folding seats respectively installed on tops of the two folding telescopic frames, and the two flip-folding seats are connected through a gear case and a coupling.

10. The device of claim 8, comprises a flip-folding seat installed on a top of the folding telescopic frame, and the flip-folding seat is hinged with an upper end of the folding telescopic frame.

11. The device of claim 7, wherein the multifunctional support frame comprises a support base, two support rods, and two elbow and underarm dual-purpose support brackets; the support base is located at a bottom of the multifunctional support frame, the two support rods symmetrically positioned above the support base; the support rods are connected to a support adjustment rod via a cam handle, and a reinforcing flange is arranged below the support adjustment rod; the elbow and underarm dual-purpose support brackets are horizontally positioned at a top of the support adjustment rod.

12. The device of claim 7, wherein the lower leg length adjustment frame comprises a U-shaped frame, guide rods, and a first slider; the lower leg length adjustment frame is connected to the two swing angle frames through two ends of the U-shaped frame, respectively; a footrest plate mounted on the first slider, and slides along a length direction of the guide rod on the U-shaped frame to adjust its relative position to the U-shaped frame, in order to accommodate the leg length of users of different heights.

13. The device of claim 7, comprises a terminal support frame and a display screen, the terminal support frame is used to support and adjust height and angle of the display screen.

14. The device of claim 7, wherein the body data collection component comprises a first sensor group, a second sensor group, and a third sensor group for collecting body data of the user, and the motion quantity data collection component comprises a fourth sensor group for collecting the user's motion quantity data.

15. The device of claim 14, wherein the first sensor group comprises photoelectric sensors placed in front of and behind the foot pedals on the support component; two receiving ends of the photoelectric sensors are vertically positioned above its two emitting ends respectively; when the user performs leg swinging movements, if the receiving end receives the photoelectric signal which is not blocked by the user, the first sensor group output a value of 0 for trunk upright status, i.e. k1=0; when the receiving end does not receive the photoelectric signal due to it being blocked by the user, the first sensor group output a value of 1 for the upright trunk status, i.e. k1=1.

16. The device of claim 14, wherein the second sensor group comprises displacement sensors placed on the lower leg length adjustment frame corresponding to the back of the user's knees; the displacement sensors continuously collect a fitting status of the user's leg with the lower leg length adjustment frame; when the leg is fitted to the frame, the second sensor group output a value of 0 for the upright status of the leg, i.e. k2=0; when they are not, the second sensor group output a value of 1 for the upright status of the leg, i.e. k2=1.

17. The device of claim 14, wherein the third sensor group comprises weight sensors placed under the foot pedals of the support component to continuously collect the user's weight data;

a method for calculating the supporting leg load reduction indicative value, comprising: determine whether S or N is in a range of Δa, if it is within the range, the third sensor group output is k3=0; otherwise, the output is k3=1;

wherein S represents ratio of the supporting leg load reduction while on support of two sides of the body to body weight, N represents ratio of the supporting leg load reduction while on support of the chest front to body weight, Δa represents the supporting leg load reduction in the graduated treatment models.

18. The device of claim 14, wherein the fourth sensor group comprises a photoelectric sensor on a side of the outer shell and a distance sensor; a method for collecting the movement amplitude involves placing a distance sensor on the surface of the bottom support of the support component; the movement amplitude θ is calculated as $\theta=\arctan(D/(H-L))$, wherein H is the distance from the user's leg pivot to the surface of the bottom support, L is the distance between the distance sensor and the obstructing object, and D is the projected distance from the distance sensor to the user's leg pivot.

19. The device of claim 1, wherein the body data collection component and the motion quantity collection component are achieved functions by selecting one or more from the following: ultrasonic sensor, displacement sensor, gravity sensor, photoelectric sensor, radar, camera.

* * * * *